US007390141B2

(12) United States Patent
Rytand

(10) Patent No.: US 7,390,141 B2
(45) Date of Patent: Jun. 24, 2008

(54) WAVE-ATTENUATING SYSTEM

(76) Inventor: David H. Rytand, P.O. Box 1169, Anacortes, WA (US) 98221

( * ) Notice: Subject to any disclaimer, the term of this patent is extended or adjusted under 35 U.S.C. 154(b) by 229 days.

(21) Appl. No.: 11/145,041

(22) Filed: Jun. 3, 2005

(65) Prior Publication Data

US 2005/0271470 A1 Dec. 8, 2005

Related U.S. Application Data

(60) Provisional application No. 60/557,246, filed on Jun. 3, 2004.

(51) Int. Cl.
*E02B 3/04* (2006.01)
*B63C 1/00* (2006.01)

(52) U.S. Cl. ..... 405/23; 405/64; 405/65; 405/104; 405/219; 405/220; 405/221

(58) Field of Classification Search ..... 405/23, 405/103, 104, 107, 114, 115, 195.6, 196, 405/218, 219, 221, 63–65; 4/488
See application file for complete search history.

(56) References Cited

U.S. PATENT DOCUMENTS 3,818,708 A * 6/1974 Benson ..... 405/65
4,033,137 A * 7/1977 Geist ..... 405/71
4,136,994 A 1/1979 Fuller
4,234,266 A 11/1980 Angioletti
4,406,564 A 9/1983 Hanson
4,468,151 A 8/1984 Warlick
4,691,661 A 9/1987 Deiana
4,756,033 A * 7/1988 Schelfhorst ..... 4/506
4,940,021 A 7/1990 Rytand (Continued)

OTHER PUBLICATIONS

Website, *Korea Research Institute of Ships & Ocean Engineering*, http://www.kriso.re.kr/english/intro_004b2_content.html, http://www.kriso.re.kr/english/intro_004b_content.html, 3 pages (publication date unknown).

(Continued)

*Primary Examiner*—Tara L. Mayo
(74) *Attorney, Agent, or Firm*—Klarquist Sparkman, LLP

(57) ABSTRACT

A wave-attenuating system. The wave-attenuating system includes a flexible, resilient barrier member that is disposed in a body of water and oriented to interrupt and dissipate the wave action of oncoming waves. The barrier member desirably is constructed from a substantially neutrally or slightly negatively buoyant material so that the overall depth, length, and/or thickness can be increased as needed for a particular application while adding little deadweight to the system in water. The barrier member can be supported by a flotation device in a floating breakwater, or alternatively, the barrier member can be secured to a stationary structure in a fixed breakwater.

16 Claims, 21 Drawing Sheets

U.S. PATENT DOCUMENTS

| | | | | |
|---|---|---|---|---|
| 5,304,005 | A | 4/1994 | Loeffler-Lenz | |
| 5,398,633 | A | 3/1995 | Loverich et al. | |
| 5,429,452 | A | 7/1995 | Frost | |
| 5,517,936 | A | 5/1996 | Mennucci et al. | |
| 5,529,012 | A | 6/1996 | Rytand | |
| 5,879,105 | A | 3/1999 | Bishop et al. | |
| 6,409,431 | B1 * | 6/2002 | Lynch | 405/200 |
| 6,450,737 | B1 | 9/2002 | Rytand et al. | |
| 6,558,075 | B2 * | 5/2003 | Benedict et al. | 405/21 |
| 6,567,341 | B2 * | 5/2003 | Dreyer et al. | 367/1 |
| 6,660,170 | B2 * | 12/2003 | Dreyer et al. | 210/747 |
| 6,976,807 | B2 * | 12/2005 | King et al. | 405/26 |
| 2001/0055516 | A1 * | 12/2001 | King et al. | 405/28 |
| 2003/0044233 | A1 * | 3/2003 | Hillard et al. | 405/21 |
| 2004/0120770 | A1 * | 6/2004 | Miyazaki | 405/63 |
| 2004/0234339 | A1 * | 11/2004 | Dreyer | 405/63 |

OTHER PUBLICATIONS

"Elemental Innovation Launches New Halo Wave Attenuator To Provide Comprehensive Protection of Shore," Pressbox.co.uk, http://www.pressbox.co.uk/Detailed/9602.html, 2 pages, (Oct. 2, 2003).

"Halo Ocean Wave Attenuator," Elemental Innovation, 2 pages, publication date unknown.

* cited by examiner 24
60
58
54
56
32
50
48
70
52
80
84
78
86
64
62
68

500
502
518
514
516
508a
526
12
540
508b 524
508
522
528

520
504
506
510
542
544
578

512
600
12
604B
30
604
646
638
16c
622
76
636b
508
636a
632b
608
624
604A
609

WAVE-ATTENUATING SYSTEM

CROSS-REFERENCE TO RELATED APPLICATION

The present application claims the benefit of U.S. Provisional Application No. 60/577,246, filed Jun. 3, 2004.

FIELD

The present invention concerns embodiments of a wave-attenuating system, used to assist in controlling the effects of waves in bodies of water.

BACKGROUND

Wave-attenuation structures (also referred to as breakwaters) are generally classified into three different types of structures: (1) mounds of rubble or rock placed on the seabed, (2) fixed walls anchored to the seabed, and (3) floating structures anchored to the seabed with a guide pile or ground tackle.

Rubble-mound breakwaters often require a large base to be constructed on the seabed to support the weigh of the rubble. Such bases cover large areas of seabed and typically are many times wider than the above-water portion of the breakwater. Generally, in depths greater than 15 to 20 feet and in tidal ranges greater than 10 feet, construction of a rubble-mound breakwater can be both cost prohibitive and environmentally unsound.

A fixed-wall breakwater typically includes a stationary wall structure that is anchored to the seabed, such as with piles, and oriented perpendicular to the flow of waves. A drawback of typical conventional fixed-wall breakwaters is that they depend on the structural competency of the underlying soil to resist wave loads. Further, a fixed-wall breakwater presents an unsightly visual barrier and sometimes displays foul-smelling sea growth at low tide or low water level.

Floating breakwaters generally are favored over rubble-mound breakwaters and fixed-wall breakwaters because floating breakwaters generally are less cost sensitive to water depth than rubble-mound breakwaters and are less likely to obstruct the view of surrounding waters than fixed-wall breakwaters. A floating breakwater typically includes a large float structure (e.g., a concrete or plastic float) that supports one or more downwardly extending walls or keels.

To decrease wave transmission through a floating breakwater, it is known to increase the overall width of the float structure (usually to about one-quarter of the design wave length) and to increase the overall depth of the float structure and its downwardly extending walls. Unfortunately, increasing the width of a float structure increases manufacturing and transportation costs and has the undesirable effect of shading the seabed, which inhibits the growth of plant life. Additionally, since increasing the depth increases the overall load on the breakwater from oncoming waves, the overall depth of a breakwater is usually limited by the ability of the float structure to absorb and transfer wave forces into the seabed. Further, in the case of concrete breakwaters, increasing the depth of the walls adds significant weight to the breakwater. Thus, the overall depth of the walls in such breakwaters is limited by the ability of the float structure to support the added weight with sufficient freeboard.

Typical conventional floating breakwaters suffer from additional disadvantages. For example, existing floating breakwaters rely on the structural integrity of the float structure to resist wave forces, which are transferred to an anchor system and into the seabed. In addition, such breakwaters typically employ a flat surface oriented perpendicular to the flow of oncoming waves at the leading edge of the float structure. This produces standing and reflected waves at the leading edge of the float structure, which nearly doubles the magnitude of the load of an incident wave. Unfortunately, the connection points of the float structure (e.g., the connections that secure wales to the sides of a float structure) often become points of progressive failure.

Accordingly, there exists a continuing need for new and improved wave-attenuating systems.

SUMMARY

The present disclosure concerns embodiments of a wave-attenuating system. According to one aspect, the wave-attenuating system includes a flexible, resilient barrier member that is disposed in a body of water and oriented to interrupt and dissipate the wave action of oncoming waves. The barrier member exhibits sufficient flexibility to deform and absorb at least some of the forces of oncoming waves, but yet has sufficient strength so that it will not tear or break under anticipated loads. The barrier member desirably is constructed from a substantially neutrally or slightly negatively buoyant material so that the overall depth, length, and/or thickness can be increased as needed for a particular application while adding little deadweight to the system in water. The ability to increase the depth of the barrier member without adding significant deadweight in water is particularly significant, since increasing depth increases the amount of wave attenuation.

One such material that can be used for the barrier member is a fabric-carcassed, elastomeric belting material, such as commonly used in conveyor equipment. In some embodiments, the density of such material is about 68.2 lbs./ft$^3$ or less.

In particular embodiments, the wave-attenuating system is a floating breakwater that includes a float structure, such as a floating dock, that floats upon the water surface and supports a downwardly extending barrier member. In alternative embodiments, the wave-attenuating system is a fixed breakwater in which the barrier member is secured to a stationary structure (e.g., a series of piles) that is anchored to the seabed.

The floating breakwater in certain embodiments includes one or more generally tubular sleeves that are mounted to the float structure. Each sleeve is disposed around a respective pile that extends into the seabed. The sleeves are slidable or otherwise movable relative to the piles so that the float structure and the barrier member can rise and fall as the level of the water surface changes, such as from changes in the tide. The barrier member desirably extends horizontally between the piles and vertically along the lengths of the sleeves.

In operation, wave energy from waves impacting the barrier member can be transferred directly to the piles and into the ground, without imparting significant horizontal loads on the float structure. In certain embodiments, the float structure can be connected to the sleeves via a flexible connector, which can be one or more layers of a strong, flexible material, such as the previously mentioned elastomeric belting material. This allows limited twisting and listing of the float structure relative to the sleeves and piles, which prevents the sleeves from binding against the piles as the float structure and sleeves rise and fall with changes in the water level.

In some embodiments, one or more additional sleeves are disposed on the piles and are spaced longitudinally from each other along the length of the respective piles. The barrier member extends vertically along the length of the piles and is secured to the sleeves.

Mechanical stops or equivalent mechanisms can be mounted to the lower end portion of the piles to limit downward travel of the lowermost sleeve on each pile. The stops function to maintain a predetermined minimum spacing between the barrier member bottom edge and the seabed so as to define a channel allowing fish to pass underneath the barrier member. However, in alternative embodiments, the barrier member can be allowed to extend all the way to the seabed.

The portions of the barrier member between the sleeves exhibit sufficient flexibility to deflect under the weight of the float structure when the water level lowers, and to return to its normal, non-deflected shape when the water level rises and the weight of the float structure is removed from the barrier member. In this manner, the relative depth or draft of the barrier member with respect to the depth of the water is substantially constant despite changes in the level of the water surface.

In another embodiment, a mooring system can be used in lieu of piles to anchor the float structure and the barrier member to the seabed. In one implementation, for example, the float structure supports the barrier member as previously described, and ground tackle (e.g., a chain, cable, or rope) is connected at one end to the bottom portion of the barrier member and at the opposite end to a gravity anchor.

The foregoing and other features and advantages of the invention will become more apparent from the following detailed description of several embodiments, which proceeds with reference to the accompanying figures.

BRIEF DESCRIPTION OF THE DRAWINGS

FIG. 8F shows a top plan view showing a plurality of tubular flotation elements used in one of the flotation subassemblies of the wave-attenuating system of FIG. 8A, and an end view of the tubular flotation elements.

DETAILED DESCRIPTION

As used herein, the singular forms "a," "an," and "the" refer to one or more than one, unless the context clearly dictates otherwise.

As used herein, the term "includes" means "comprises."

First Representative Embodiment

Figures 1A, 1B, 1C:
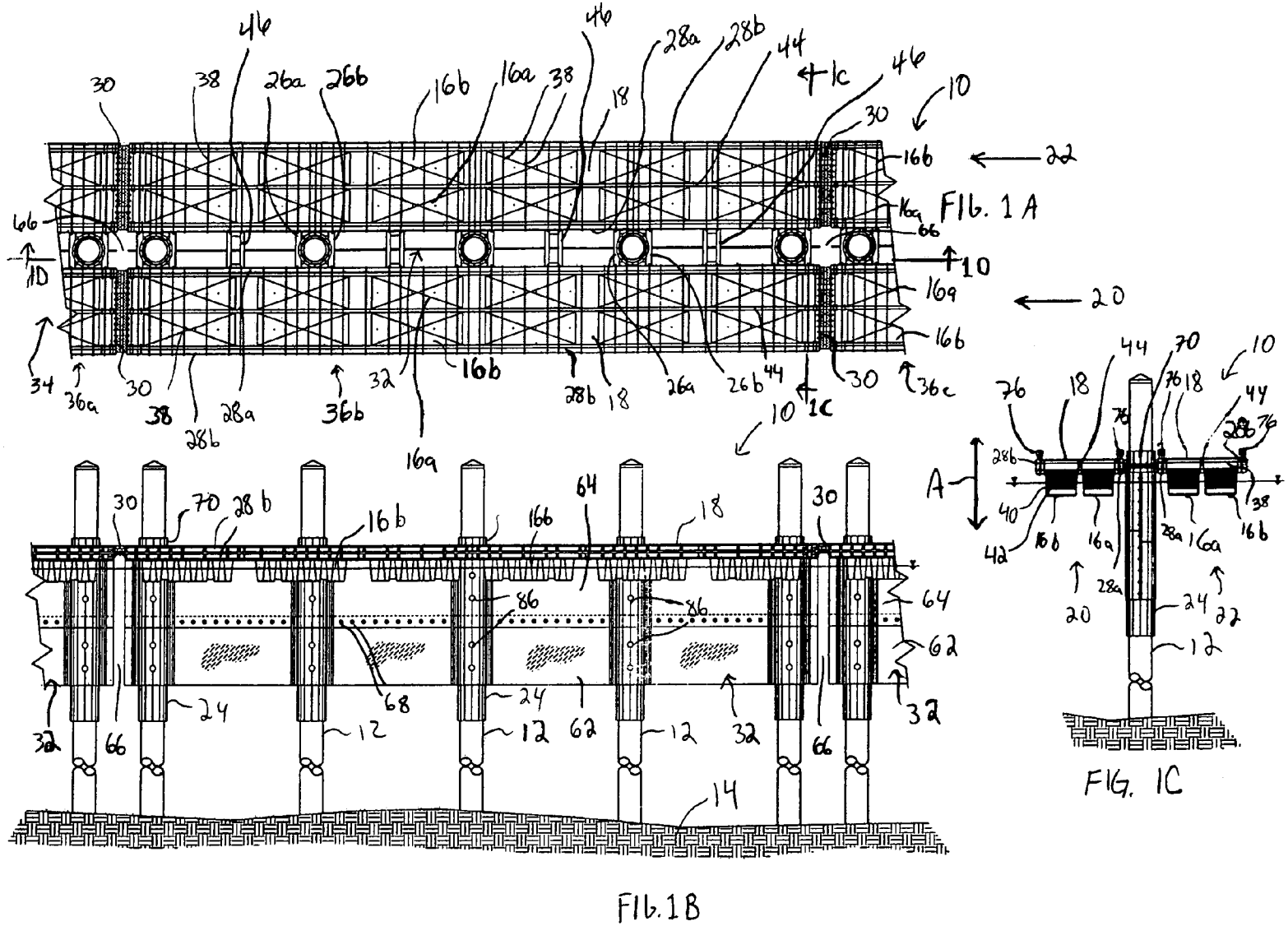
FIG. 1A is a top plan view of a wave-attenuating system according to a first embodiment.
FIG. 1B is a front elevation view of the wave-attenuating system of FIG. 1A.
FIG. 1C is a partial cross-sectional view of the wave-attenuating system taken along line 1C-1C of FIG. 1A.
Figure 1D:
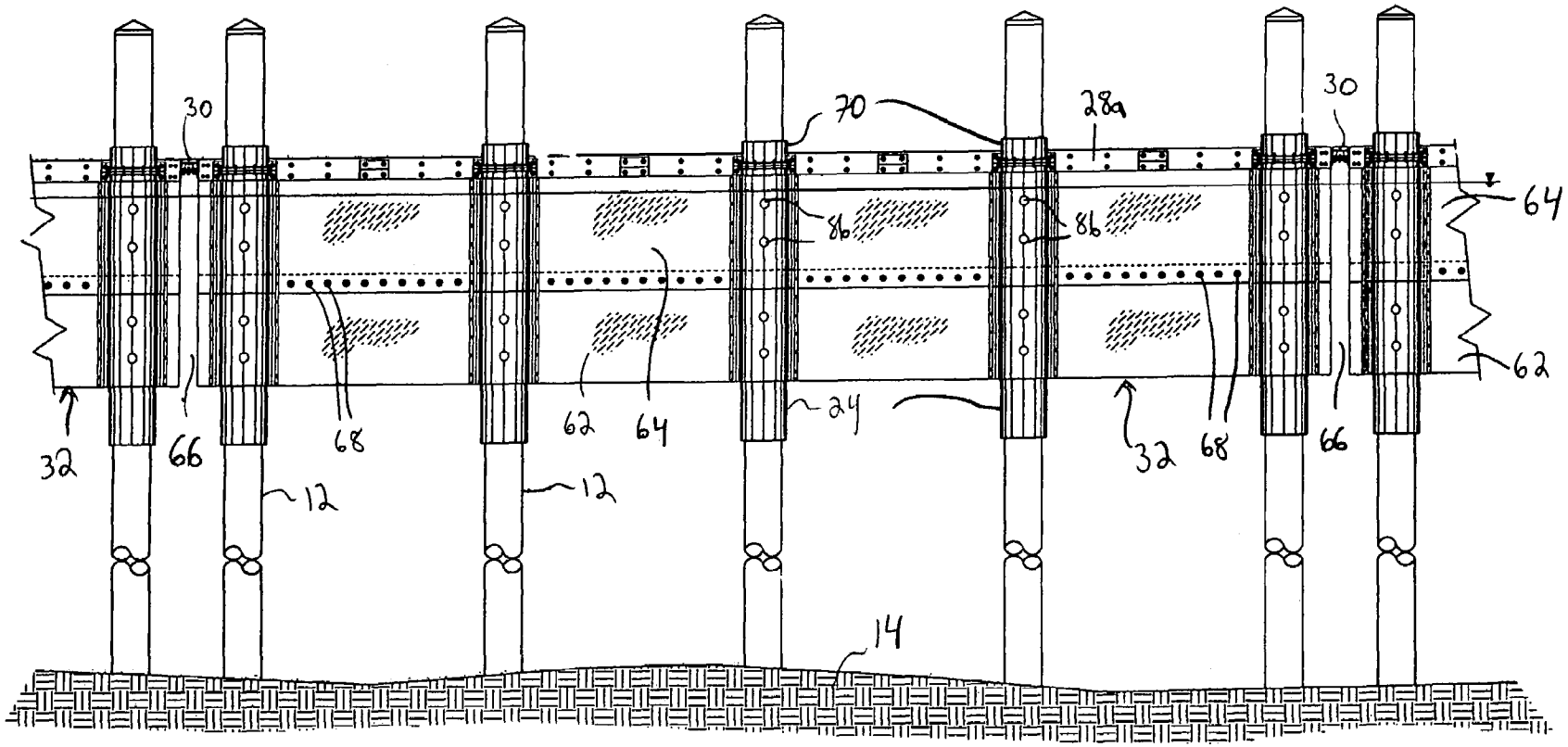
FIG. 1D is an elevation view of the wave-attenuating system taken along line 1D-1D of FIG. 1A.

Referring first to FIGS. 1A-1D, there is shown a wave-attenuating system 10 according to a first representative embodiment. As best shown in FIGS. 1B and 1D, the wave-attenuating system 10 in the illustrated embodiment generally includes one or more upright piles 12 anchored in the seabed 14, a generally vertically disposed, flexible barrier member 32 oriented generally perpendicular to the flow of waves, and one or more buoyant flotation members (also referred to herein in other embodiments as floats, flotation devices or float structures) for supporting the barrier member 32. Although the piles 12 are shown to extend perpendicularly with respect to the seabed, the piles may be skewed or angled with respect to a line that extends perpendicularly with respect to the seabed. As used herein, the term "seabed" is used generically to refer to an underwater surface in any type of body of water (e.g., sea, river, etc).

The flotation members can be any of various devices that can float upon the surface of the water. For example, the flotation members can comprise one or more floating dock sections, such as the illustrated dock sections 16*a* and 16*b* (as best shown in FIGS. 1A and 1C).

The construction of dock sections 16*a*, 16*b* can be conventional. Accordingly, any of various types of floating docks can be implemented in the wave-attenuating system 10. In the illustrated embodiment, for example, each dock section comprises a shell structure 40 (e.g., a concrete or plastic shell) containing a buoyant core 42 (e.g., a polystyrene block) (as best shown in FIG. 1C). Other examples of floating docks that can be implemented in the wave-attenuating system are described in, for example, U.S. Pat. No. 6,450,737 (the '737 patent) and U.S. Pat. No. 4,940,021 (the '021 patent), which are incorporated herein by reference.

As shown in FIG. 1A, the wave-attenuating system 10 in the illustrated embodiment includes a dock assembly 34 that comprises a plurality of dock sub-assemblies 36*a*, 36*b*, and 36*c* positioned end-to-end with respect to each other. Each dock sub-assembly includes a first array 20 of two side-by-side rows of dock sections 16*a* and 16*b* positioned on one side of the piles 12 and a second array 22 of two side-by-side rows of dock sections 16*a* and 16*b* positioned on the opposite of the piles. The pairs of dock sections 16*a*, 16*b* can be spaced longitudinally from each other along the length of each array 20, 22 (as best shown in FIG. 1B).

The dock sections 16*a*, 16*b* in each array 20, 22 can be interconnected with each other by a plurality of elongated wales 28*a* and 28*b* (FIGS. 1A and 1B) extending along opposing longitudinal sides of each array 20, 22. An elongated intermediate wale 44 (or a plurality of wales placed end-to-end) can be positioned between the two rows of dock sections in each array 20, 22. The wales can be constructed from any of various suitable materials, such as, e.g., wood or glulam (glue-laminated timber).

A series of compression rods 38 extend transversely through dock sections 16*a*, 16 and wales 28*a*, 28*b*, and 44. Nuts (not shown) on the ends of the compression rods 38 are torqued to cause a compression force to be exerted on opposing wales 28*a*, 28*b*. The dock assembly 34 can have an upper walking surface, or pedestrian deck, 18. Various mooring accessories, such as the illustrated bullrails 76 (FIG. 1C), can be mounted to the upper surfaces of wales 28*a*, 28*b* to allow boats to be moored along side the dock assembly 34 in a conventional manner.

The construction of the individual dock sections and the manner in which the dock sections are interconnected to each other is further described in the '021 patent. As shown in FIG. 1A, the adjacent ends of the dock sub-assemblies 36*a*, 36*b*, and 36*c* can be coupled to each other via flexible hinges 30, such as disclosed in the '737 patent or U.S. Pat. No. 5,529,012 (the '012 patent), which is incorporated herein by reference.

In an alternative embodiment, the ends of each dock section 16*a*, 16*b* can be interconnected to respective adjacent ends of dock sections in the same row using, for example, flexible hinges, such as disclosed in the '737 patent or the '012 patent to permit limited relative movement between individual dock sections. In this alternative embodiment, wales 28*a* and 28*b* would not be needed to interconnect the dock sections.

Figure 3B:
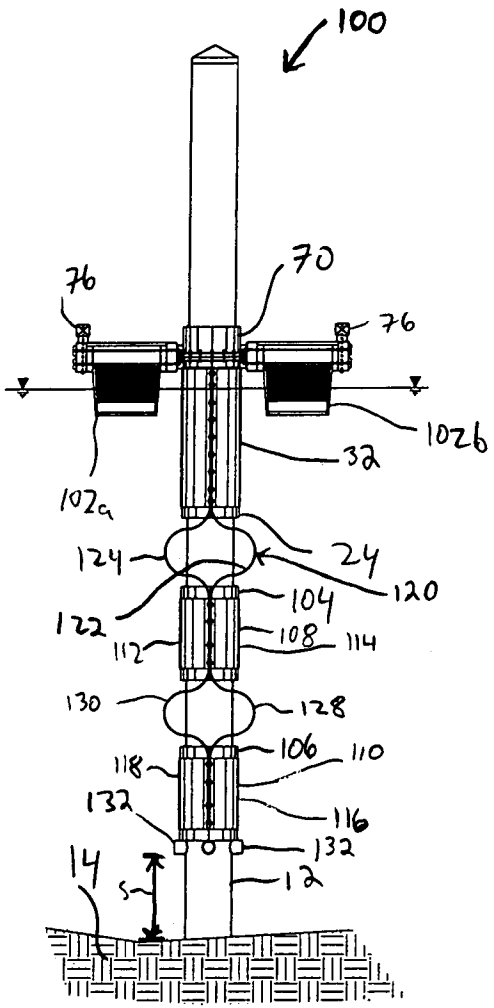
FIG. 3B is a side elevation view similar to FIG. 3A, showing the flotation assembly at a lower water level.
Figure 3A:
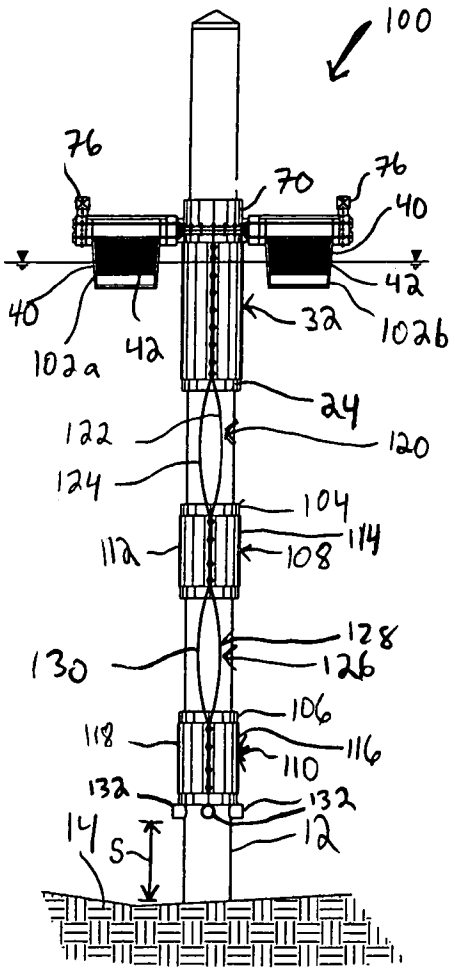
FIG. 3A is a side elevation view of a wave-attenuating system, according to a second embodiment, showing a flotation assembly at a high water level.

The configuration of the dock assembly 34 or individual docks is not limited to that shown in the illustrated embodiment. Accordingly, the dock assembly can include any number of individual dock sections or rows of dock sections, which can be arranged in various dock configurations. For example, one or both arrays of dock sections can include one row of dock sections (e.g., as shown in FIGS. 3A and 3B) or more than two rows of side-by-side dock sections. Still alternatively, the floating dock can include an array of dock sections on only one side of the piles 12.

The piles 12, which are anchored into the seabed, restrict lateral or horizontal movement of the dock sections 16*a*, 16*b* while allowing them to rise and fall as the level of the water surface changes (as indicated by double-headed arrow A in FIG. 1C), such as from changes in the tide. In alternative embodiments, the dock sections 16 can be anchored by other techniques or mechanisms, such as a mooring configuration employing lines or chains that tie off the dock to gravity anchors on the seabed. The dock sections 16*a*, 16*b* in the illustrated configuration are coupled to the piles 12 via elongated, tubular sleeves 24 that are mounted for sliding movement along the length of the piles. The sleeves 24 can be constructed from a low-friction, non-corrosive material, such as high-density polyethylene. In particular embodiments, for example, the sleeves 24 can comprise DRISCOPIPE® (Performance Pipe, Inc., Plano, Tex.), PLEXCO® (Performance Pipe, Inc.), or POLYPIPE® (PolyPipe, Inc., Gainesville, Tex.) polyethylene pipe. Desirably, each sleeve 24 has an inner diameter that is dimensioned to establish a gap or spacing between the inner surface of the sleeve and the outer surface of a respective pile. This allows a water bearing to form between the sleeve and the pile, which serves to facilitate sliding movement of the sleeve and absorb wave energy transferred from the sleeve to the pile.

As best shown in FIG. 1A, pairs of brackets or supports 26*a* and 26*b* extend transversely between the inner row of dock sections 16*a* of the first array 20 and the inner row of dock sections 16*a* of the second array 22 to connect the first array to the second array. The ends of the supports 26*a*, 26*b* can be connected to respective side wales 28*a* via respective compression rods 38, although other suitable fastening or attachment mechanisms can be used to mount the supports 26*a*, 26*b* to the dock sections 16*a*. Each pair of supports 26*a*, 26*b* also serves to mount a respective sleeve 24. Additional brackets 46 can extend transversely between the inner rows of dock sections 16*a* to enhance the connection strength between the first and second arrays 20, 22. The brackets 46 can be connected to respective side wales 28*a* via respective compression rods 38 or other suitable mechanisms.

The barrier member 32 in the illustrated embodiment desirably is supported by the sleeves 24, and extends longitudinally (i.e., in the direction of the length of the dock assembly 34) in the space between the first and second arrays 20, 22, and vertically along the length of the piles. In addition, the barrier member 32 desirably extends in a plane that intersects a vertical mid-plane of each pile (i.e., a vertical plane bisecting the piles 12). However, in other embodiments the barrier member 32 can be supported at different positions on the dock assembly. For example, the barrier member 32 can be supported directly from side wales 28*a* or side wales 28*b* of the first or second arrays 20, 22 of dock sections.

In the illustrated configuration, the barrier member 32 extends continuously between the respective ends of each dock subassembly 36*a*, 36*b*, and 36*c*, and is formed with gaps or spaces 66 (FIGS. 1A, 1B, and 1D) between the adjacent ends of subassemblies 36*a*, 36*b*, and 36*c* so that the barrier member does not inhibit relative movement between the dock subassemblies. However, in another implementation, the barrier member 32 extends continuously between the dock subassemblies without any gaps 66. The overall depth or draft of the barrier member 32 (the distance between the top edge and bottom edge of the barrier member) depends on the particular installation, and can be extended to any water depth to provide for the most effective wave control. Although flexible, the barrier member in certain embodiments exhibits sufficient rigidity to allow the ends of the barrier member to be extended longitudinally beyond the ends of the dock assembly (not shown in the drawings) to a certain extent without the need for additional support structure.

Figures 2A, 2B, 2C, 2D:
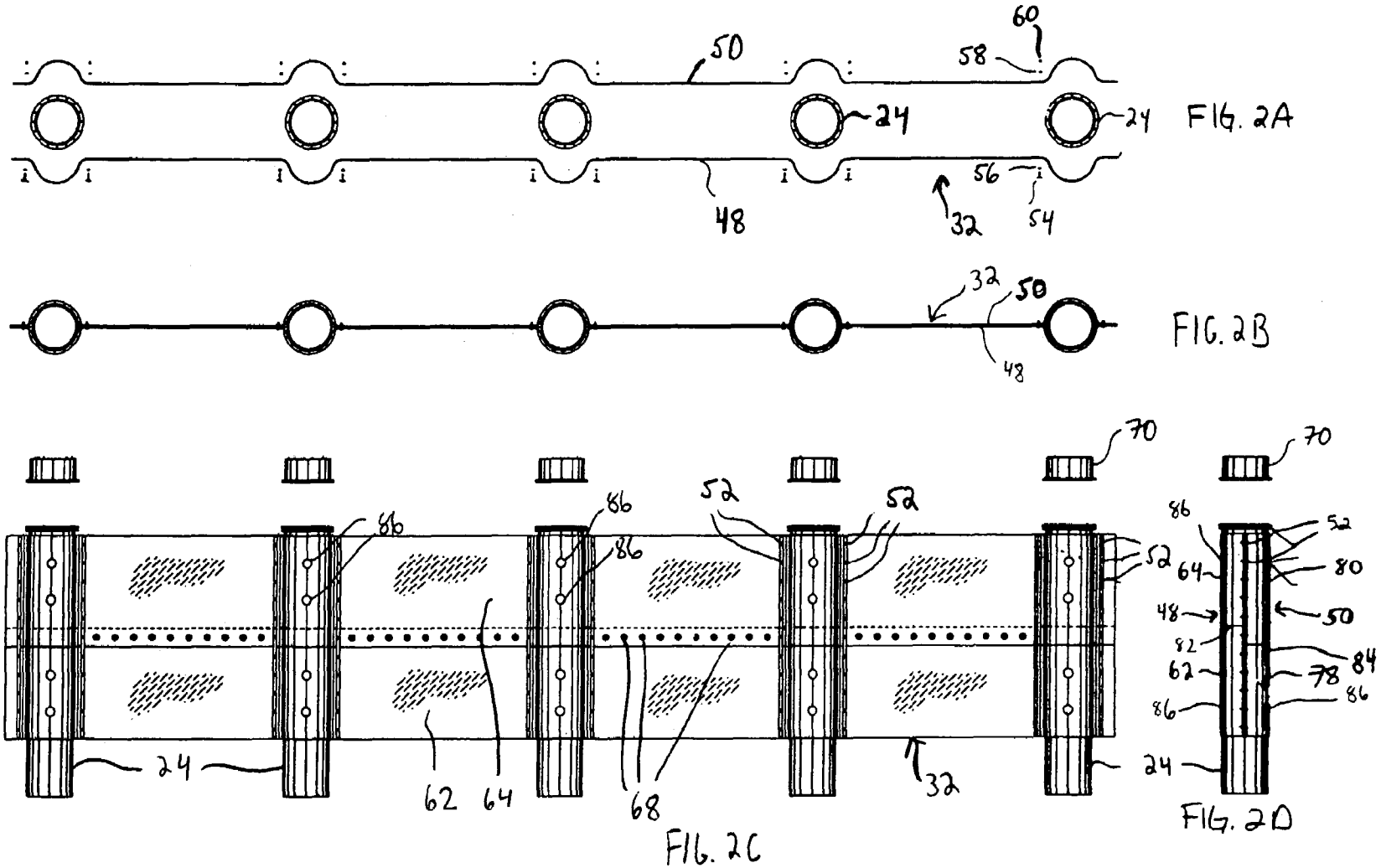
FIG. 2A is an exploded view of the barrier member and sleeves of the wave-attenuating system of FIG. 1A, as viewed from above.
FIG. 2B is a top plan view of the barrier member and sleeves shown in FIG. 2A.
FIG. 2C is a front elevation view of the barrier member and sleeves shown in FIGS. 2A and 2B.
FIG. 2D is a side elevation view of the barrier member and sleeves shown in FIG. 2C.

As shown in FIGS. 2A and 2B, the illustrated barrier member 32 can include a first layer or sheet 48 and a second layer or sheet 50 placed in a face-to-face relationship with the first layer 48. The layers 48, 50 can be secured to the sleeves 24 by positioning the sleeves 24 between the first and second layers 48, 50, and securing together the first and second layers so that the sleeves 24 are retained therebetween.

For example, as shown in FIGS. 2A, 2C and 2D, a plurality of bolt assemblies 52 for fastening together the first and second layers 48, 50 are spaced along the depth of the barrier member 32 (i.e., from the top edge to the bottom edge of the barrier member) on opposite side of each sleeve 24. As shown in FIG. 2A, each bolt assembly 52 can include a bolt 54, a first bearing strip 56 on one side of the barrier member, a second bearing strip 58 on the other side of the barrier member, and a nut 60 that is tightened on the end of a respective bolt 54. The bolts 54, bearing strips 56, 58, and nuts 54 can be made of a material that is non-corroding in a marine environment (e.g., fiberglass).

The sleeves 24 can include a plurality of horizontal projections 86 (FIGS. 1B, 1C, 2C and 2D) that are vertically spaced along diametrically opposing sides of each sleeve. The projections 86 are received in corresponding apertures formed in layers 48, 50 of the barrier member 32. The projections 86 function to inhibit vertical movement or shearing of the barrier member 32 relative to the sleeves 24.

As best shown in FIG. 2D, layer 48 of the barrier member 32 can comprise a bottom portion or section 62 positioned side-by-side with a top portion or section 64. Similarly, layer 50 can comprise a bottom section 78 positioned side-by-side with a top section 80. If desired, additional sections can be added to each layer 48, 50 to increase the overall depth of the barrier member. Alternatively, each layer of the barrier member can be a one-piece, monolithic layer.

As shown in FIG. 2D, the depth of top section 64 of layer 48 can be less than the depth of top section 80 of layer 50 (or vice versa) so that the longitudinal seam 82 between sections 62 and 64 of layer 48 is offset from or staggered relative to the longitudinal seam 84 between sections 78 and 80 of layer 50. Advantageously, this configuration inhibits the flow of water through the barrier member 32. However, in other embodiments, the layers of the barrier member can comprise multiple sections that are of the same depth. Optional bolts 68 or other suitable fasteners can be used to secure bottom section 64 of layer 48 to top section 80 of layer 50.

The barrier member 32 can be constructed from a corrosion-resistant, resilient, and/or semi-flexible material. As used herein, "semi-flexible material" refers to material that is flexible enough to deform or deflect under the force of incoming waves, but yet has sufficient strength so that it will not break or tear under the anticipated loads. In addition, the barrier member desirably is constructed from a substantially neutrally buoyant or slightly negatively buoyant material. In particular embodiments, the barrier member has a density of about 68.2 lbs./ft$^3$ or less, and more particularly 63.2 lbs./ft$^3$, although the density could be greater than 68.2 lbs./ft$^3$.

Suitable materials that can be used for the barrier member include, without limitation, elastomers, fabrics, polymers or various combinations thereof. In particular embodiments, for example, the layers 48, 50 of barrier member 32 are constructed from elastomeric belting material commonly used in conveyor equipment. One example of such material is PLYLON® fabric-carcassed, rubber belting material manufactured by the Goodyear Tire and Rubber Company of Akron, Ohio, which has a density of about 1.02. Although variable, the thickness of each layer 48, 50 in certain embodiments can be about ½ to 1 inch.

By selecting a material that has a density of one or slightly greater than one allows the dimensions (length, depth and/or thickness) of the barrier member to be increased as needed for a particular application while adding little, if any, deadweight to the system in water. For example, wave action extends well below the water surface. Hence, the depth of the barrier member can be extended as needed to provide the most effective wave control. In addition, the depth of the barrier member can be easily increased by adding additional sections 62, 64 to each layer. Advantageously, installation of additional sections does not complicate construction of the system and does not significantly increase manufacturing costs.

In operation, an incoming wave impacts the barrier member 32, which transfers a portion of the wave's energy to the seabed through sleeves 24 and piles 12. The water bearings between the sleeves and the piles function to cushion impact loads on the barrier member and reduce shock loading of the piles. Abatement of wave energy is also accomplished through slight deformation of the barrier member, which alternatively compresses and expands in response to wave action. In addition, since the flotation assembly rides on top of the water surface, kinetic energy of an oncoming wave is dissipated as the flotation assembly is lifted by the wave. The cumulative effect reduces the size of oncoming waves and creates a flatter, calmer surface on the other side of the barrier member 32.

By supporting the barrier member 32 at a position laterally offset from the leading edge of the dock assembly 34 (the edge closest to the oncoming wave), the accumulation of wave energy from standing and reflected waves at the leading edge of the dock assembly is reduced. This reduces loading on the dock sections (or other flotation devices used to support the barrier member), and more importantly, the connections between the dock sections. In addition, since the barrier member is connected to the sleeves 24, wave energy from waves impacting the barrier member are transferred directly to the piles 12 and into the seabed so as to avoid or at least minimize horizontal loads from being transferred to the dock sections and their connections. Additionally, this greatly simplifies an engineering analysis of the forces acting upon the wave-attenuating system since in some cases there may be no need to generate a load path through the dock sections or other flotation devices used to support the barrier member.

Further, since abatement of wave action is primarily accomplished through the vertical barrier member, the overall footprint of the flotation assembly can be minimized to minimize manufacturing and transportation costs. In addition, the relatively narrow flotation assembly minimizes shading of the underlying seabed.

Second Representative Embodiment

FIGS. 3A and 3B illustrate another embodiment of a wave-attenuating system, indicated at 100. This embodiment shares many similarities with the embodiment of FIGS. 1A-1D and 2A-D. Hence, components in FIGS. 3A and 3B that are identical to corresponding components in FIGS. 1A-1D and 2A-D have the same respective reference numerals and are not described further.

The wave-attenuating system 100 in the illustrated embodiment generally includes a row of one or more dock sections 102*a* on one side of one or more piles 12 and a row of one or more dock sections 102*b* on the opposite side of the piles 12. The illustrated wave-attenuating system 100 also includes sleeves 24 mounted between dock sections 102*a*, 102*b*, and one or more additional sleeves 104 and 106 disposed around respective piles 12 for sliding movement relative thereto. As shown, sleeves 24, 104, and 106 are spaced apart from each other along the length of the respective piles 12.

A barrier member 108 extends horizontally between the piles 12 and vertically along the length of the sleeves 104. Similarly, a barrier member 110 extends horizontally between the piles 12 and vertically along the length of the sleeves 106. The barrier member 108 can comprise first and second layers 112 and 114, respectively, that extend around the outer surfaces of sleeves 104 and are connected to each other on opposite sides of each sleeve 104 in the same manner that the barrier member 32 is coupled to sleeves 24. The barrier member 110 can comprise first and second layers 116 and 118, respectively, that are coupled to the sleeves 106 in a similar fashion.

A barrier member 120 extends horizontally between adjacent piles 12 and vertically between the bottom of barrier member 32 and the top of barrier member 108. The barrier member 120 in the illustrated embodiment comprises first and second layers 122 and 124, respectively, although in other embodiments one layer or more than two layers can be used. The barrier member 120 can be connected along its top and bottom edges to adjacent edges of barrier members 32 and 108 using suitable fasteners. In addition, a barrier member 126 extends horizontally between adjacent piles 12 and vertically between the bottom of barrier member 108 and the top of barrier member 110. The barrier member 110 can include first and second layers 128 and 130, respectively, and can be connected along its top and bottom edges to adjacent edge portions of barrier members 108 and 110 using suitable fasteners. As can be appreciated, barrier members 32, 108, 110, 120, and 126 collectively define a barrier member assembly extending from the top of sleeves 24 to the bottom of sleeves 106.

One or more stops 132 or equivalent mechanism can be mounted on the lower end portion of pile 12 to limit the downward travel of the lowermost sleeve 106. The stops 132 maintain a minimum spacing S between the sleeve 106 and the seabed 14 through which fish can pass. In lieu of stops, the lowermost sleeve 106 can fixedly secured to the pile to prevent any sliding movement relative to the pile. In another embodiment, the barrier member assembly can extend all the way to the seabed.

The wave-attenuating system 100 provides a constant barrier for the entire water column between the water surface and the stops 132 despite changes in the level of the water surface. As can be appreciated from FIGS. 3A and 3B, the layers of barrier members 120 and 126 are sufficiently flexible to permit the sleeves 24, 104, and 106 to slide toward and away from each other. Thus, when the water level falls from a first level (FIG. 3A) to a second, lower level (FIG. 3B), the barrier members 120, 126 deform under the weight of the dock sections 102*a*, 102*b*. Conversely, when the water level rises, the weight of the dock sections 102*a*, 102*b* on barrier members 120, 126 is removed, which allows the barrier members to return to their normal, non-deflected state.

Third Representative Embodiment

Figure 4:
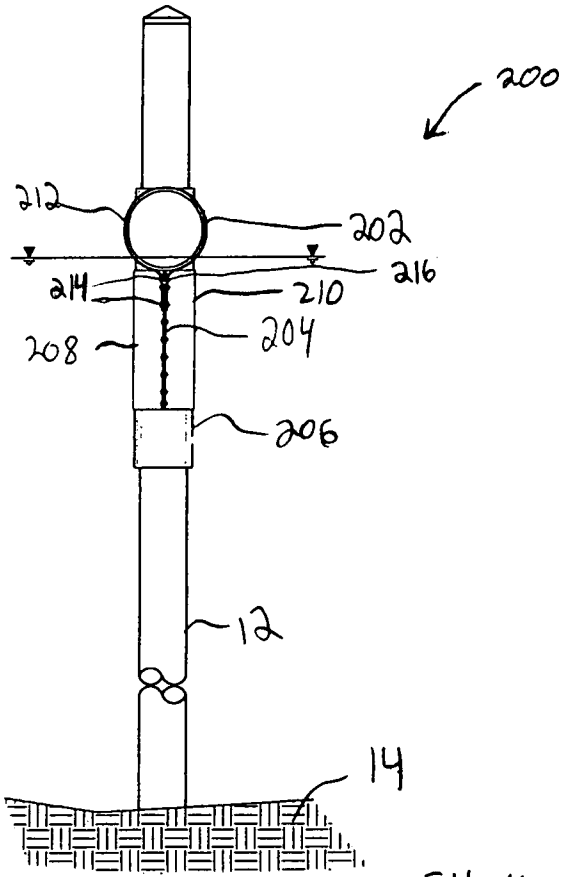
FIG. 4 is a side elevation view of a wave-attenuating system, according to a third embodiment.

FIG. 4 illustrates a wave-attenuating system 200, according to another embodiment. In this embodiment, the wave-attenuating system 200 generally includes one or more flotation devices 202, one or more piles 12, and a sleeve 206 slidably disposed on each pile 12. The flotation device 202 in this embodiment comprises an elongated, hollow tube or pipe made of a non-corrosive material, such as high-density polyethylene or various other suitable materials. If desired, the flotation device can house a buoyant material, such as a polystyrene block, to increase its buoyancy and/or a neutrally buoyant or a negatively buoyant material (e.g., water, sand, etc.) to serve as a ballast for the flotation device. Each flotation device 202 in the illustrated configuration extends horizontally between a pair of adjacent piles 12.

A barrier member 204 extends horizontally between the piles 12 and vertically along the length of the sleeves 206. The barrier member 204 can comprise first and second layers 208 and 210, respectively, that extend around the outer surfaces of sleeves 206 and are connected to each other on opposite sides of each sleeve 206. In the illustrated embodiment, the barrier member 204 is connected to the flotation device 202 via a flexible member 212, which can be constructed from the same material as the barrier member (e.g., PLYLON® belting material). Member 212 is wrapped around the flotation device 202 and overlaps opposite sides of the top edge portion of barrier member 204. Non-corrosive bolts 214 and respective nuts 216 are used to secure member 212 to the barrier member 204. In other embodiments, other techniques or mechanisms can be employed to secure the flotation device 202 to the barrier member 204.

The wave-attenuating system 200 operates in a manner similar to the wave-attenuating system 10 and can be used in applications where a pedestrian deck is not needed or desired. Additionally, the flotation devices 202 of FIG. 4 can replace the dock sections 102*a*, 102*b* in the system shown in FIGS. 3A and 3B.

Fourth Representative Embodiment

Figure 5:
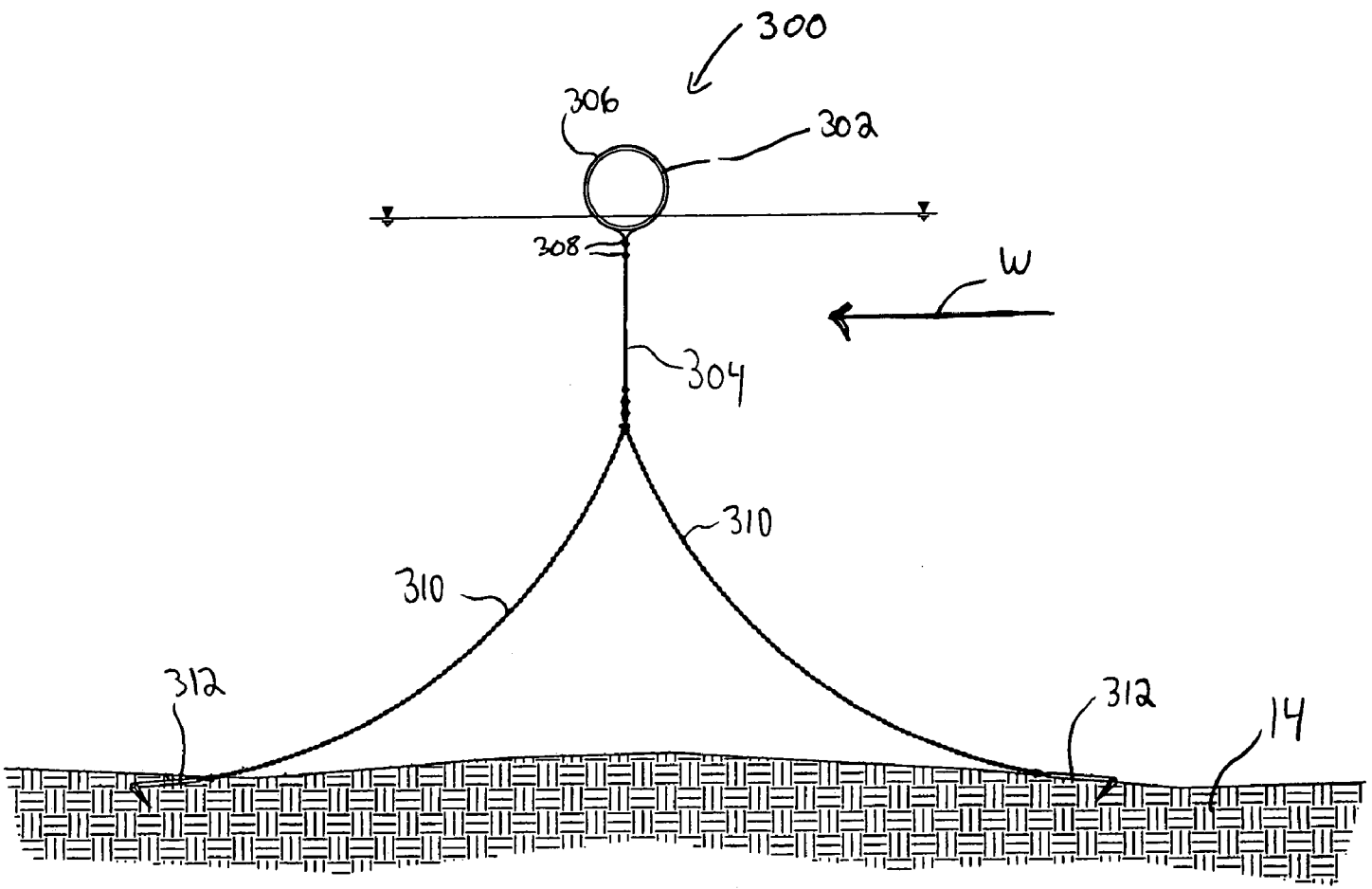
FIG. 5 is a side elevation view of a wave-attenuating system, according to a fourth embodiment.

FIG. 5 illustrates another embodiment of a wave-attenuating system, which is indicated generally at 300. The wave-attenuating system 300 includes a flotation device 302 that comprises an elongated, hollow tube or pipe made of a non-corrosive material, such as high-density polyethylene or various other suitable materials. If desired, the flotation device can house a buoyant material, such as a polystyrene block, to increase its buoyancy and/or a neutrally buoyant or a negatively buoyant material (e.g., water, sand, etc.) to serve as a ballast for the flotation device. A barrier member 304 comprising one or more layers of a flexible and/or resilient material (e.g., elastomeric belting material) is supported by the flotation device 302 and extends horizontally and downwardly toward the seabed 14. The barrier member 304 can be coupled to the flotation device with a flexible member 306 that is wrapped around the flotation device and secured to the top edge portion of the barrier member using suitable fasteners.

In lieu of piles 12, the wave-attenuating system 300 is anchored to the seabed 14 via a mooring system. The mooring system in the illustrated embodiment comprises one or more chains 310, each of which is connected at one end to the bottom of the barrier member 304 and at its opposite end to a respective gravity anchor 312 that is anchored into the seabed 14. As shown in FIG. 5, the anchors 312 desirably are spaced in the direction of incident waves (as indicated by arrow W) on opposite sides of the barrier member 304 to stabilize and limit horizontal movement of the flotation device and barrier member.

Fifth Representative Embodiment

Figure 6:
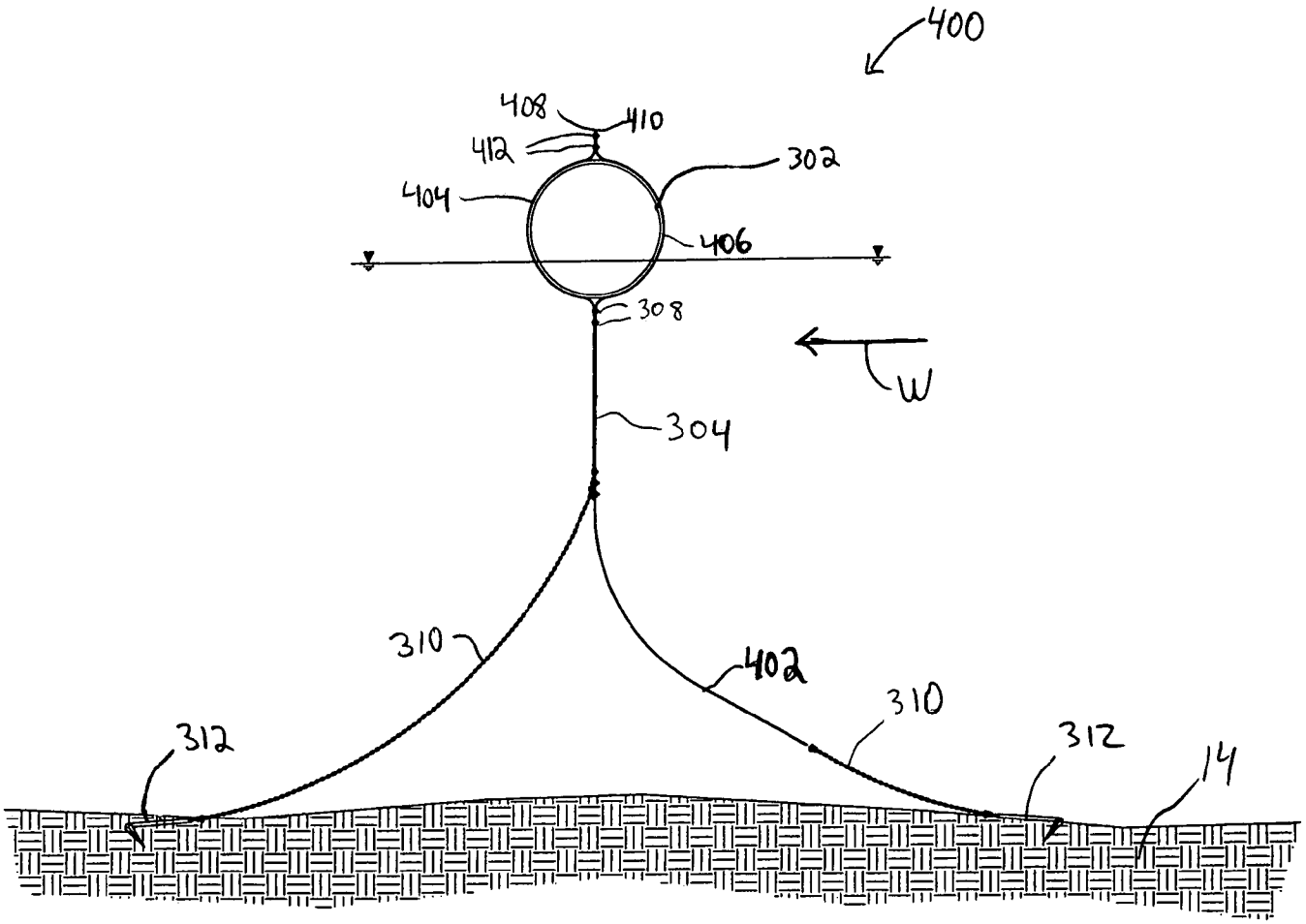
FIG. 6 is a side elevation view of a wave-attenuating system, according to a fifth embodiment.

FIG. 6 illustrates a wave-attenuating system 400, according to another embodiment. This embodiment shares many similarities with the embodiment of FIG. 5. Hence, components in FIG. 6 that are identical to corresponding components in FIG. 5 have the same respective reference numerals.

One difference between the FIG. 5 embodiment and the FIG. 6 embodiment is that the latter includes a flexible and/or resilient barrier member 402 extending downwardly from the bottom end of the barrier member 304 and forwardly in a direction opposite the direction of incoming waves. The bottom end of barrier member 402 can be anchored to the seabed 14 by a respective chain 310 and anchor 312. The barrier member 402 serves as an extension of barrier member 304 to interrupt the flow of incident waves.

The barrier member 304 in the FIG. 6 embodiment is coupled to the flotation device 302 by first and second layers 404 and 406, respectively, of a flexible and/or resilient material, that extend around opposite sides of the flotation device 302. The bottom end portions of the first and second layers 404, 406 are secured to the top edge portion of the barrier member 304 using suitable fasteners 308. The top end portions 408 and 410 of the first and second layers 404, 406, respectively, are secured to each other using suitable fasteners 412 and extend upwardly from the flotation device 302. In this manner, the top end portions 408, 410 serve as an upper extension portion of the barrier member 304 to intercept portions of overtopping waves.

Sixth Representative Embodiment

Figure 7A:
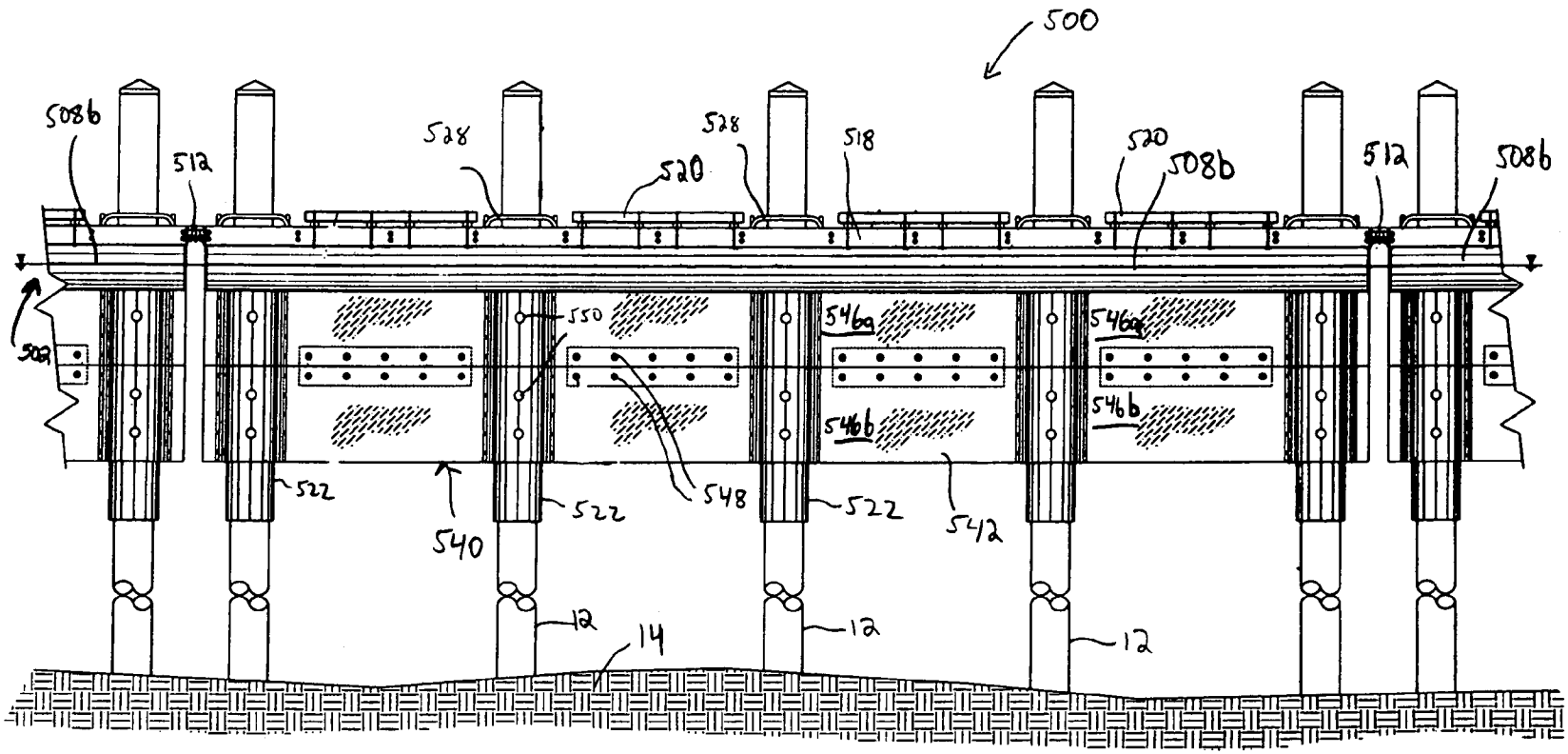
FIG. 7A is a front elevation view of a wave-attenuating system, according to a sixth embodiment.
Figures 7B, 7C, 7D, 7E, 7F:
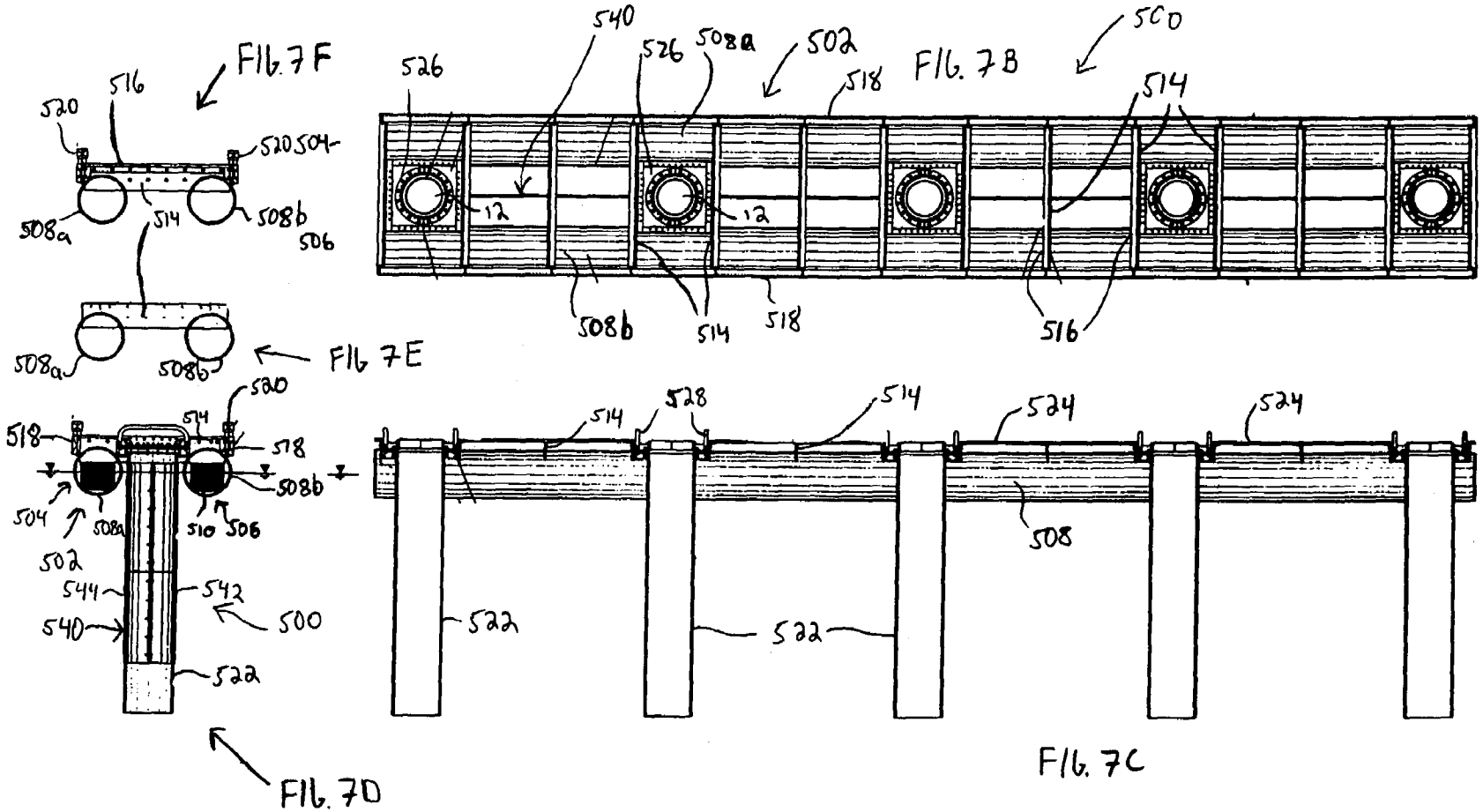
FIG. 7B is a top plan view of the wave-attenuating system shown in FIG. 7A.
FIG. 7C is a vertical cross-sectional view of the flotation assembly of the wave-attenuating system of FIG. 7A.
FIG. 7D is a side elevation view of the wave-attenuating system of FIG. 7A, showing the flotation assembly partially in section.
FIG. 7E shows two flotation devices in section, and a cross member interconnecting the flotation devices of the flotation assembly shown in FIG. 7A.
FIG. 7F is a view similar to FIG. 7E showing additional structural elements of the flotation assembly.
Figure 7I:
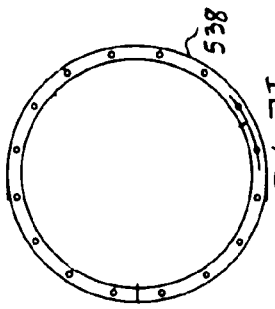
FIG. 7I is a top plan view of an annular ring used in a mounting assembly for mounting a sleeve to the flotation assembly of FIG. 7A
Figure 7J:
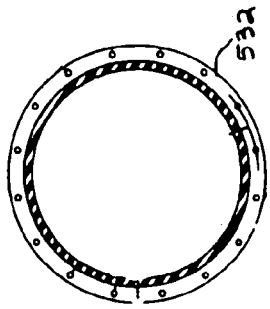
FIG. 7J is a top plan view of an annular flange used in a mounting assembly for mounting a sleeve to the flotation assembly of FIG. 7A.
Figure 7H:
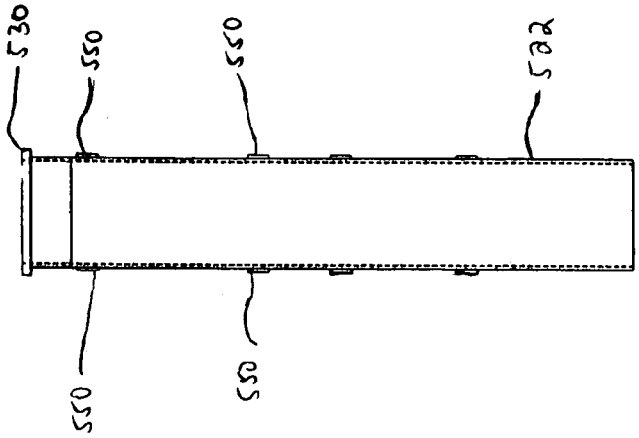
FIG. 7H is an enlarged, elevation view of a sleeve used in the wave-attenuating system of FIG. 7A.
Figure 7G:
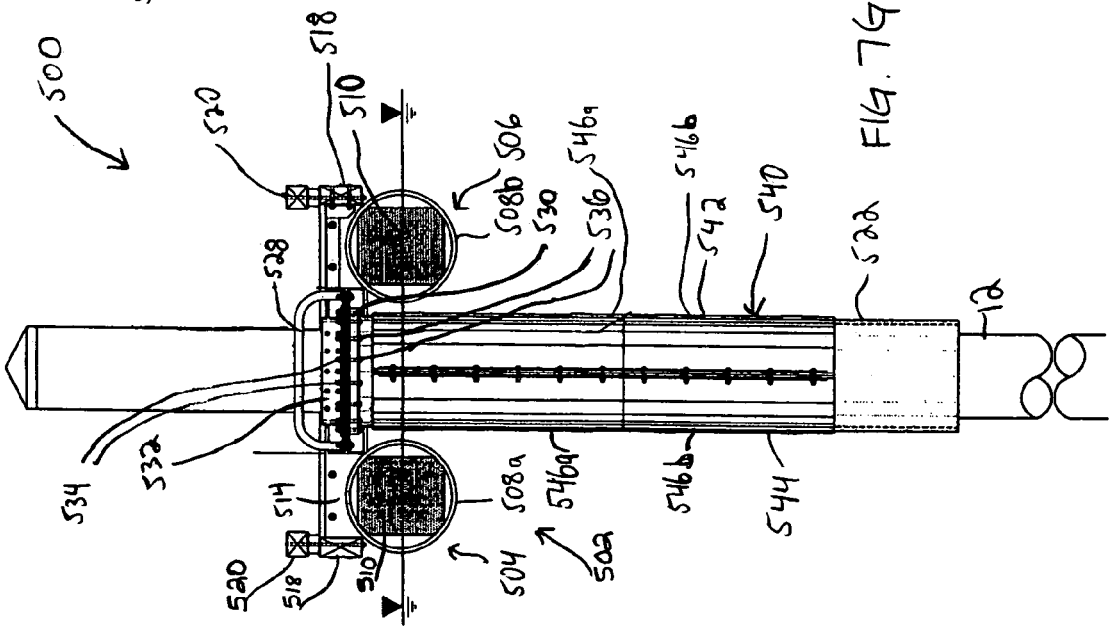
FIG. 7G is an enlarged, side elevation view of the wave-attenuating system of FIG. 7A, showing the flotation assembly partially in section.

Referring to FIGS. 7A-7J, there is shown a wave-attenuating system 500, according to a sixth representative embodiment. As best shown in FIGS. 7A, 7B, and 7D, the wave-attenuating system 500 generally includes a flotation assembly 502 that is constructed from a first row 504 of one or more flotation devices 508*a* positioned on one side of a plurality of piles 12 and a second row 506 of one or more flotation devices 508*b* positioned on the opposite side of the piles 12. The flotation devices 508*a*, 508*b* comprise, for example, high-density polyethylene pipe, although various other materials also can be used. The flotation devices 508*a*, 508*b* can house respective buoyant cores 510 (e.g., polystyrene blocks) to increase their buoyancy (FIGS. 7D and 7G). The ends of each flotation device 508*a*, 508*b* can be coupled to adjacent ends of other flotation devices in the same row via a flexible hinge 512 (FIG. 7A), such as disclosed in the '737 patent or the '012 patent. Each flotation device can be dimensioned to a have a length that spans multiple piles 12 (FIGS. 7A and 7B), although shorter flotation devices also can be used.

Each flotation device 508*a* can be connected to an adjacent flotation device 508*b* on the opposite side of the piles 12. As best shown in FIGS. 7B, 7E, and 7F, for example, a plurality of high-density polyethylene cross members 514 can extend through a pair of adjacent flotation devices 508*a* and 508*b*. Cross members 514 can be secured to flotation devices 508*a* and 508*b* using suitable techniques (e.g., welding, adhesives, or mechanical fasteners). A steel cross member 516 (FIGS. 7B and 7F) can be secured to each cross member 514 for structural reinforcement. Wales 518 (FIGS. 7A, 7B, 7D, 7F, and 7G) extend along the longitudinal sides of the flotation assembly to allow for the attachment of various mooring accessories. Wales 518 can be constructed from any suitable materials, such as glulam and can be secured to the opposite ends of cross members 516. The illustrated flotation assembly 502 includes a plurality of spaced apart bullrails 520 (FIGS. 7A, 7*d*, 7*f*, and 7G) secured along the upper surface of one or both wales 518 to provide a means for mooring boats. Bullrails 520 can be made of glulam, steel, or any of various other materials. As shown in FIG. 7C, a plurality of deck sections 524 (e.g., fiberglass grate decking) can be supported on top of cross members 514 to provide an upper walking surface.

As best shown in FIG. 7A, the wave-attenuating system 500 includes a plurality of elongated sleeves 522 disposed around respective piles 12. The sleeves 522 can be mounted to respective plate-like pile hoops 526, each of which is secured to a respective pair of cross members 514 (FIG. 7B). Each sleeve 522 in the illustrated configuration is formed with an upper flange 530 (FIGS. 7G and 7H) that mates with the bottom of a respective pile hoop 526 (FIG. 7G). As shown in FIG. 7G, an upper sleeve or ring 532 is positioned on top of the pile hoop 526 and a plurality of bolts 534 extend through corresponding holes in the ring 532, pile hoop 526 and upper flange 530 to secure the sleeve 522 to the pile hoop 526. Nuts 536 are tightened onto the ends of respective bolts 534. An annular steel ring 538 (FIG. 7I) can be positioned between upper sleeve 532 and sleeve 522 to strengthen the connection between the sleeves and the pile hoop 526. In addition, optional mooring accessories, such as the illustrated mooring bits 528, can be secured to the pile hoops 526 (FIGS. 7A and 7C).

As shown in FIGS. 7A, 7B, 7D, and 7G, a barrier member 540 extends horizontally in the direction of the length of the flotation assembly 502 and vertically along the length of the piles 12. The barrier member 540 in the illustrated embodiment comprises first and second layers 542 and 544 (FIGS. 7D and 7G). The sleeves 522 can include projections 550 (FIG. 7H) that extend into apertures formed in layers 542, 544, such as previously described with respect to the embodiments of FIGS. 1-4. As shown in FIG. 7A, each layer 542, 544 can be constructed from upper and lower sections 546*a* and 546*b* arranged side-by-side and secured to each other, such as with non-corrosive fasteners 548. Additional sections can be added to increase the depth of the barrier member.

Seventh Representative Embodiment

Figures 8A, 8B, 8C:
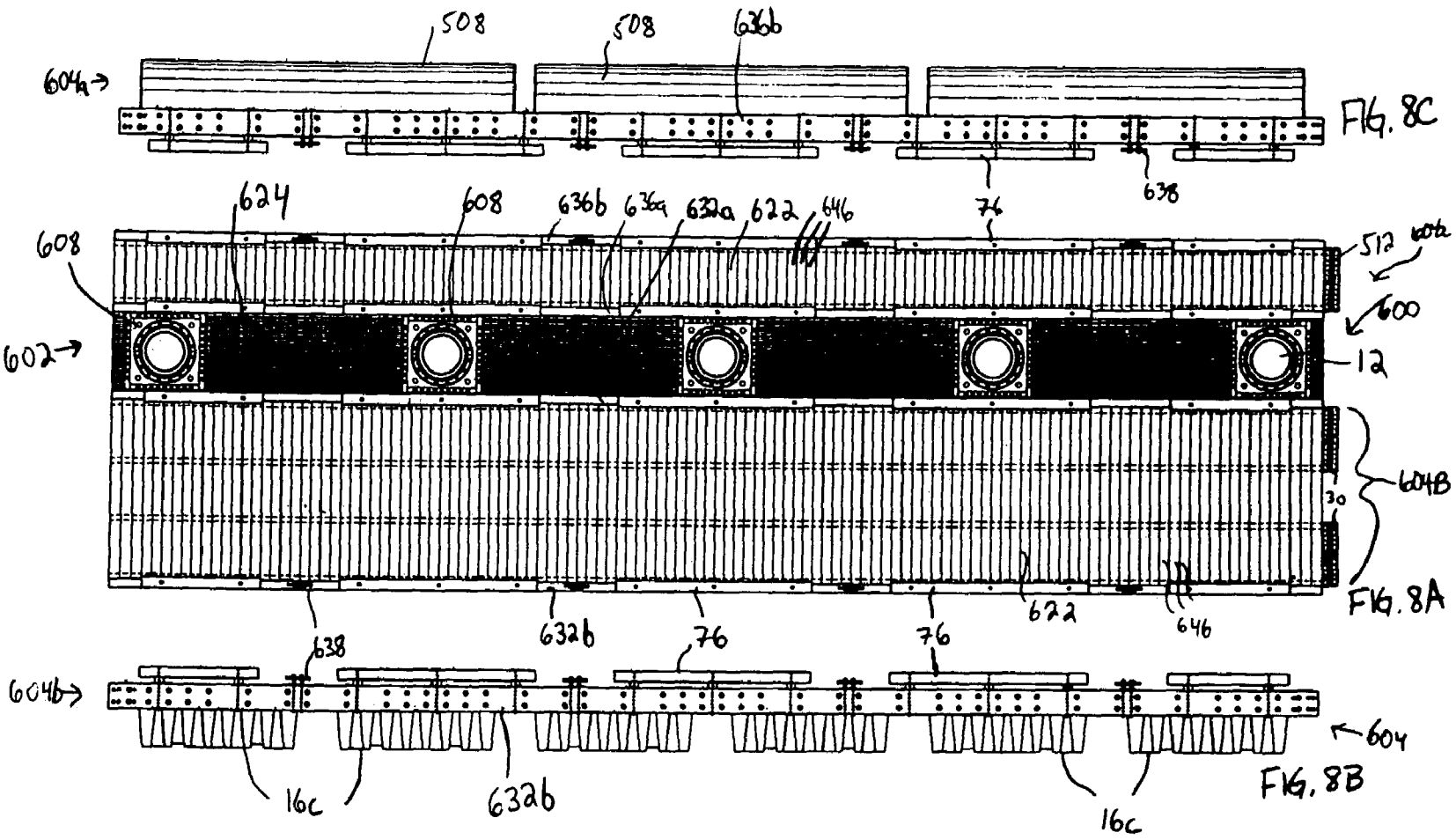
FIG. 8A is a top plan view of a wave-attenuating system, according to a seventh embodiment.
FIG. 8B is a front elevation view of the flotation assembly of the wave-attenuating system shown in FIG. 8A.
FIG. 8C is a back elevation view of the flotation assembly of the wave-attenuating system shown in FIG. 8A.
Figure 8D:
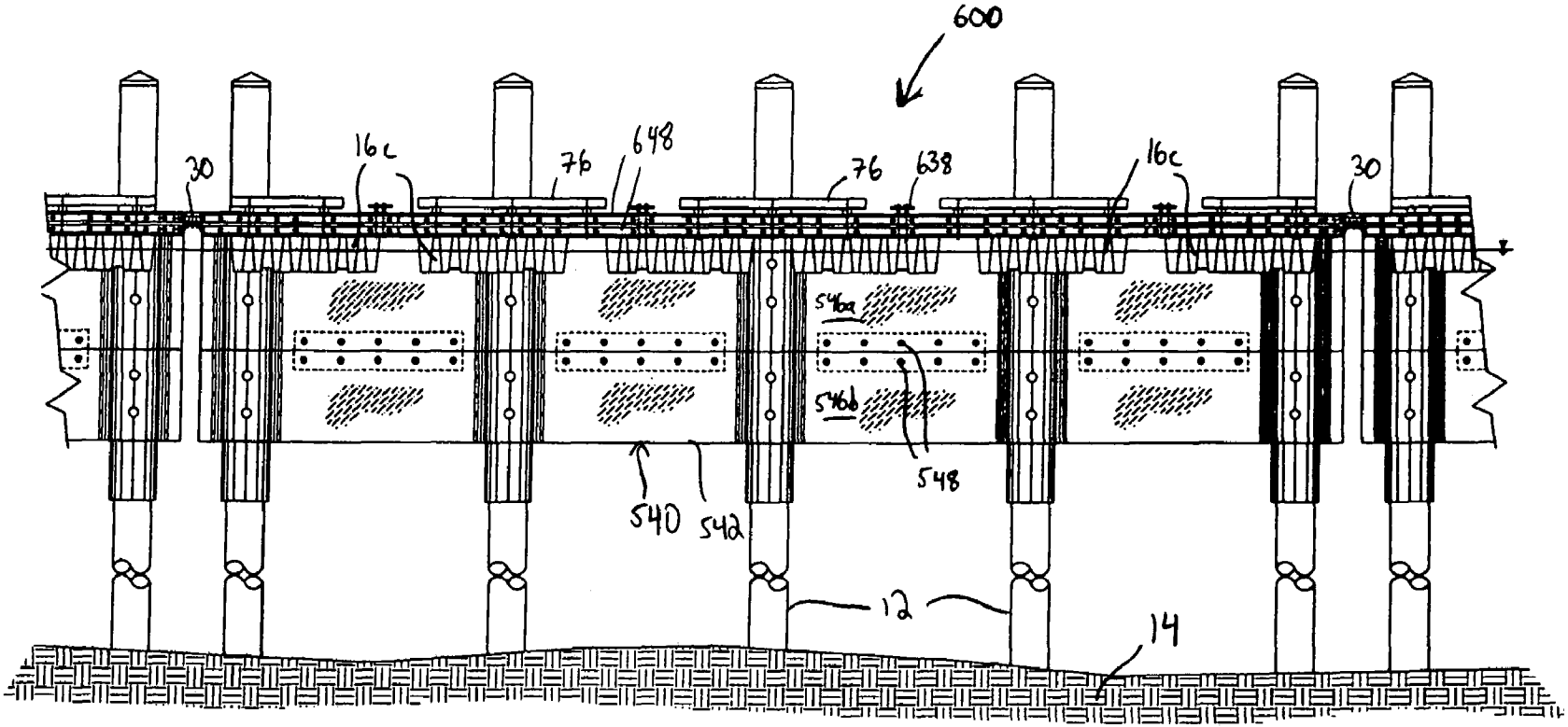
FIG. 8D is a front elevation view of the wave-attenuating system shown in FIG. 8A.
Figure 8E:
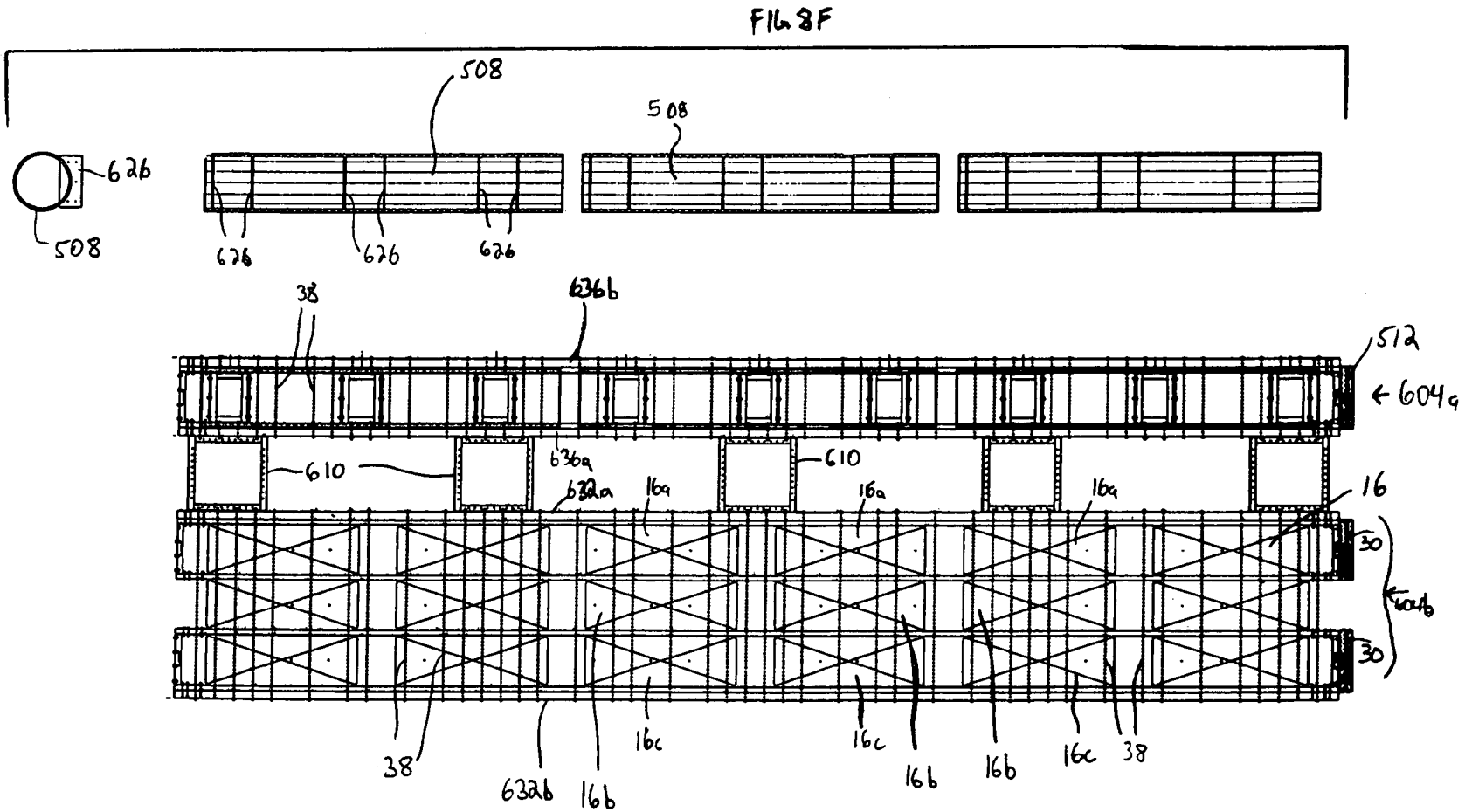
FIG. 8E is a top plan view of a portion of the wave-attenuating system of FIG. 8A, shown with the pedestrian deck removed and illustrating the connection system for interconnecting two side-by-side flotation subassemblies.
Figure 8H:
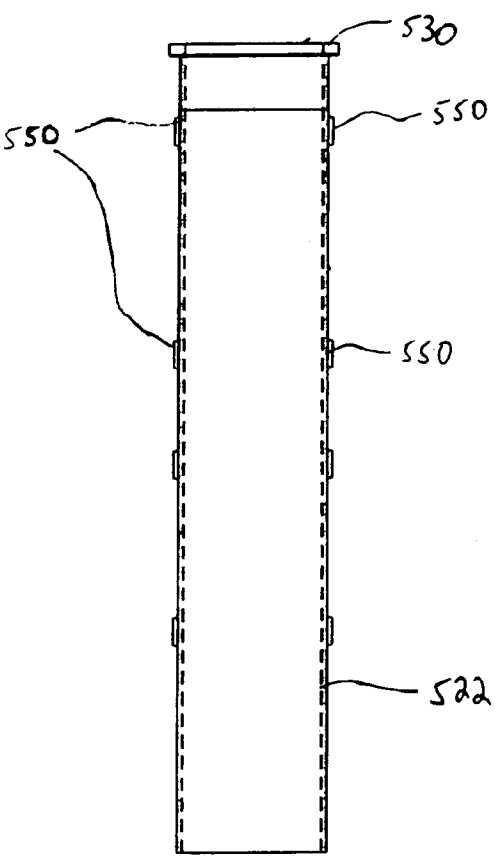
FIG. 8H is an enlarged, elevation view of a sleeve used in the wave-attenuating system of FIG. 8A.
Figure 8G:
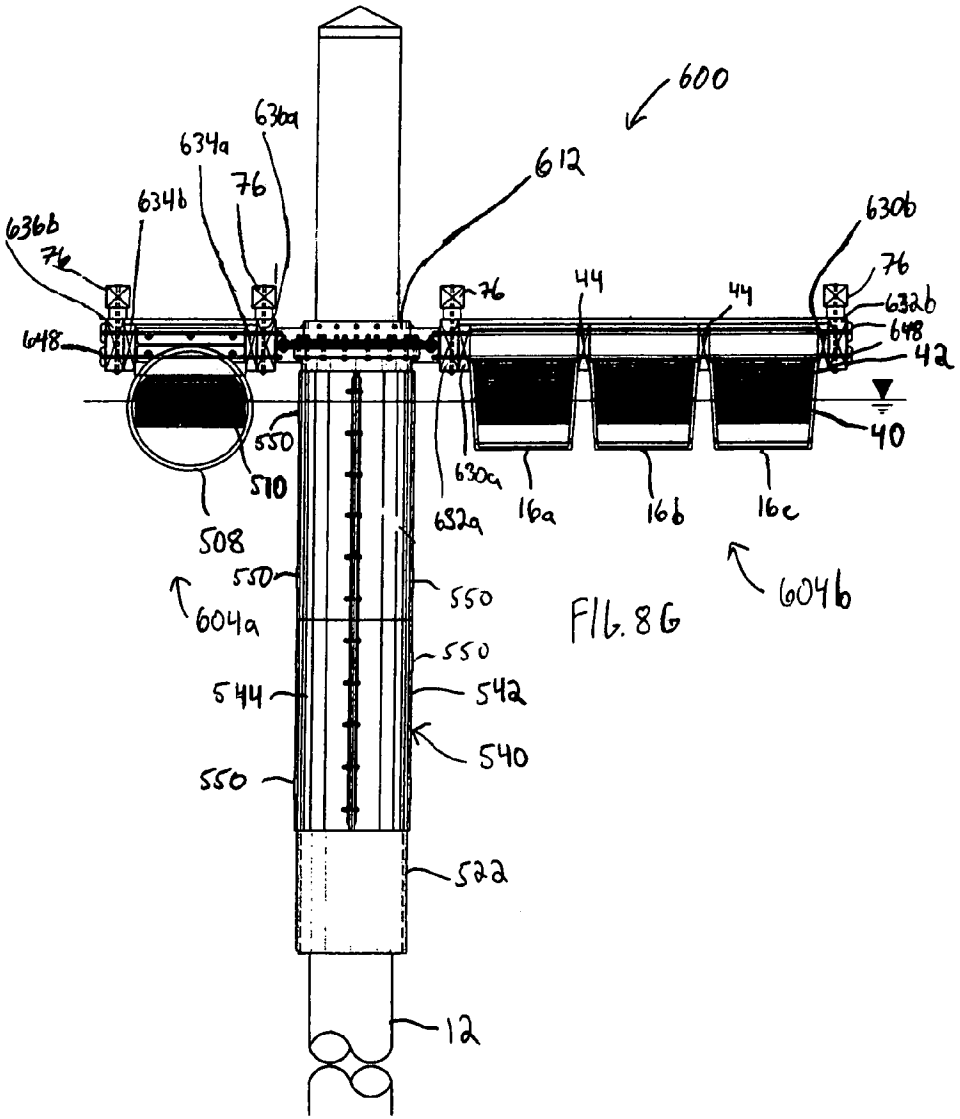
FIG. 8G is a side elevation view of wave-attenuating system of FIG. 8A showing the flotation assembly partially in section.
Figures 8I, 8J, 8K, 8L:
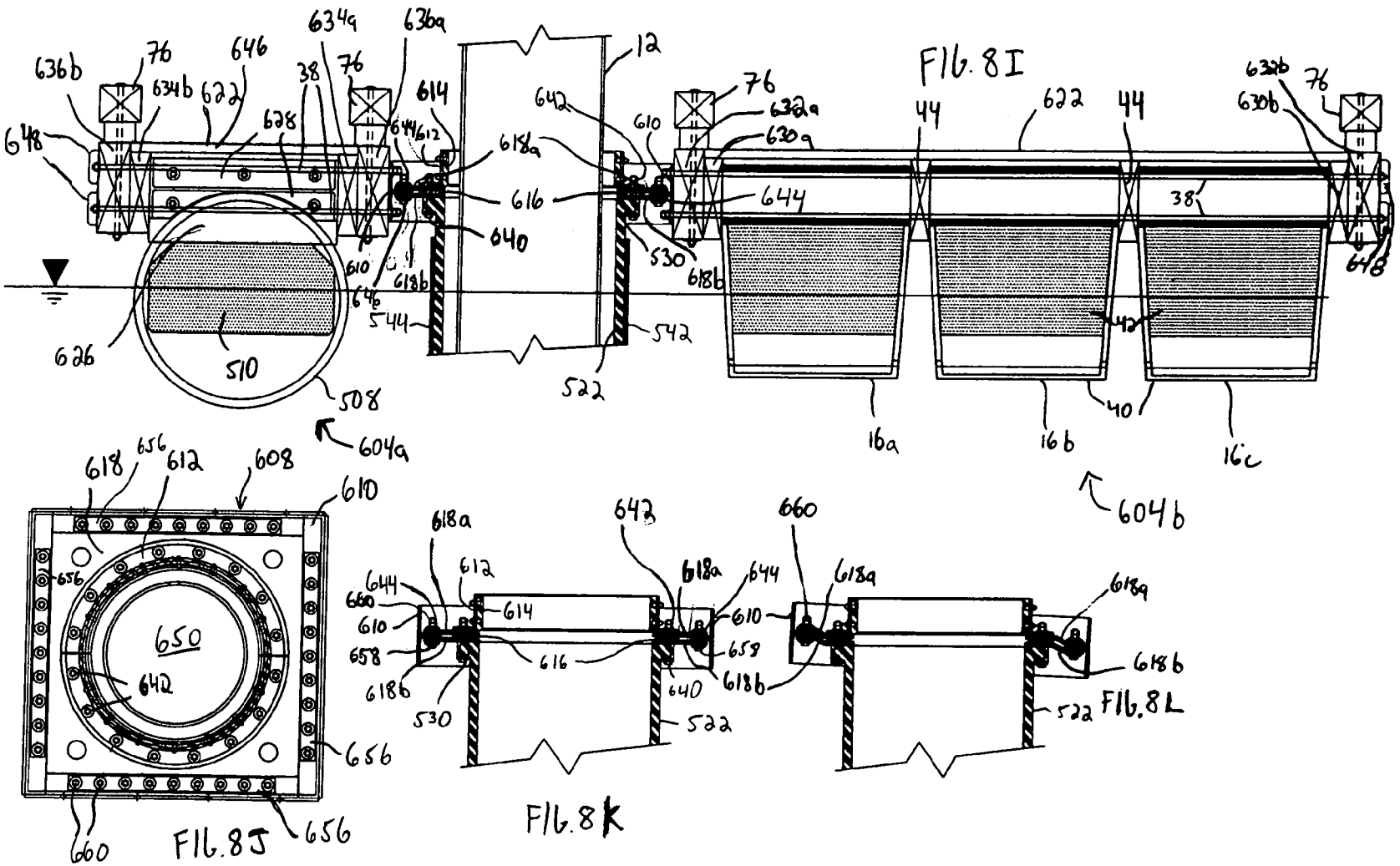
FIG. 8I is an enlarged, vertical cross-sectional view of a portion of the wave-attenuating system of FIG. 8A.
FIG. 8J is a top plan view of a connection assembly used to interconnect the flotation subassemblies in the wave-attenuating system of FIG. 8A.
FIGS. 8K and 8L are enlarged, cross-sectional views of a portion of the wave-attenuating system of FIG. 8A, illustrating the operation of the connection assembly shown in FIG. 8J.
Figure 8P:
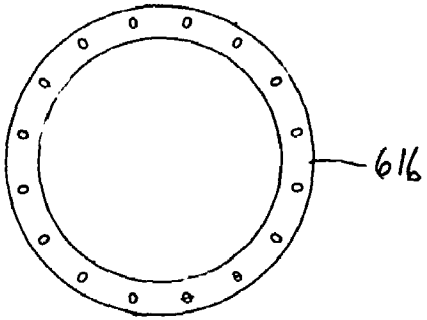
FIG. 8P is a top plan view of an annular ring used in the connection assembly shown in FIG. 8J.

Referring to FIGS. 8A-8P, there is shown a wave-attenuating system 600, according to a seventh representative embodiment. The wave-attenuating system 600 combines aspects of the wave-attenuating system 10 shown in FIGS. 1A-1D and 2A-2D and the wave-attenuating system 500 shown in FIGS. 7A-7J. Hence, components in FIGS. 8A-8P that are identical to corresponding components in FIGS. 1A-1D, 2A-2D and 7A-7J are given the same respective reference numeral.

As shown in FIGS. 8A-8C, the wave-attenuating system 600 includes a flotation assembly 602 that comprises a first flotation subassembly 604*a* positioned on one side of a plurality of piles 12 and a second flotation subassembly 604*b* positioned on the other side of the piles 12. The first flotation subassembly 604*a* comprises a series of spaced apart, tubular flotation devices 508 (FIG. 8C). As best shown in FIG. 8E, the second flotation subassembly 604*b* in the illustrated configuration comprises a first row of dock sections 16*a*, a second row of dock sections 16*b*, and a third row of dock sections 16*c*.

As shown in FIG. 8A, the flotation subassemblies 604*a*, 604*b* can have respective pedestrian decks 622. The decks 622 can be constructed from any suitable materials, such as a plurality of adjacent planks or panels 646, as illustrated in FIG. 8A. A suitable non-skid surface (not shown) (e.g., fiber cement) can be formed on top of the panels 646. A grate deck 624 can be mounted between the first and second flotation subassemblies to allow water from overtopped portions of waves to drain off of the upper surface of the flotation assembly.

The flotation devices 508 can include a plurality of plate-like cross members 626 that are supported in respective slots formed in the upper portion of the flotation devices 508 (FIGS. 8F and 8I). Cross members 626 can be welded or otherwise secured to the flotation devices 508. One or more steel plates 628 (FIG. 8I) can be secured to each cross member 626 to increase its rigidity. The cross members 626 function to support panels 646 of the pedestrian deck 622.

As best shown in FIGS. 8G and 8I, inner wales 630*a* and 630*b* are secured to opposite sides of the second flotation subassembly 604*b*, and outer wales 632*a* and 632*b* are secured to inner wales 630*a*, 630*b*, respectively. Compression rods 38 can be used to tightly secure the inner wales 630*a*, 630*b* and outer wales 632*a*, 632*b* against the sides of dock sections 16*a* and 16*c*. Similarly, inner wales 634*a* and 634*b* are secured to opposite sides of the first flotation subassembly 604*a*, and outer wales 636*a* and 636*b* are secured to inner wales 634*a*, 634*b*, respectively. Compression rods 38 can be used to tightly secure the inner wales 634*a*, 634*b* and outer wales 636*a*, 636*b* against the ends of cross members 626. Optional rub pads 648 (FIGS. 8G and 8I) cover the outside faces of outer wales 636*b* and 632*b* to provide a protective member against which moored boats may bump. The rub pads 648 are secured to the outer wales 632*b*, 636*b* by suitable fasteners, such as by respective compression rods 38. Various mooring accessories, such as the illustrated bullrails 76 and mooring cleats 638 (FIG. 8D), can be mounted to the upper surfaces of outer wales 632*a*, 632*b* and outer wales 636*a* and 636*b* (FIG. 8G)

Figure 8O:
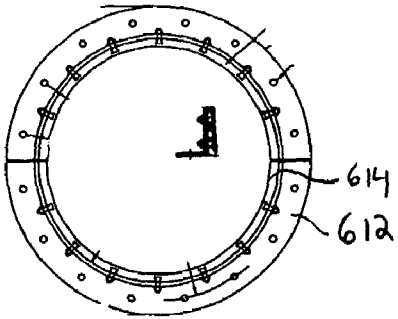
FIG. 8O is a top plan view of a pile hoop used in the connection assembly shown in FIG. 8J.
Figure 8N:
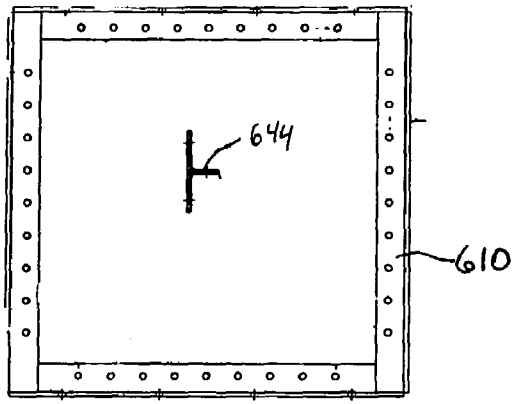
FIG. 8N is a top plan view of a rigid bracket used in the connection assembly shown in FIG. 8J.
Figure 8M:
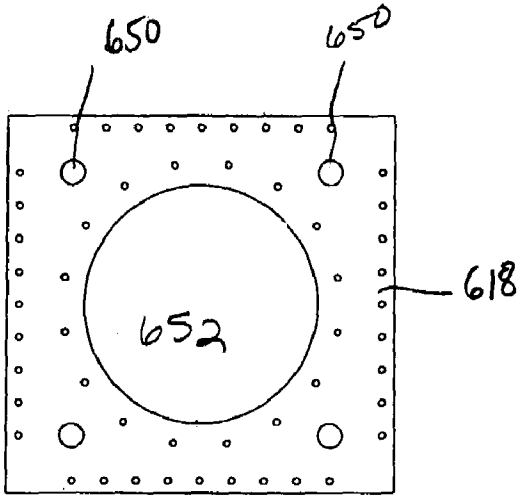
FIG. 8M is a top plan view of a layer of flexible connector used in the connection assembly shown in FIG. 8J.

The first and second flotation subassemblies 604*a*, 604*b* are coupled to each other by a plurality of longitudinally spaced apart connection assemblies 608 (FIGS. 8A and 8J). The connection assemblies 608 also function to mount sleeves 522, which are disposed around respective piles 12. Each connection assembly 608 in the illustrated form is formed with a major aperture 650 dimensioned to receive a respective pile 12, and includes a rigid bracket 610 (FIG. 8N), a pile hoop 612 (FIG. 8O), an annular ring 616 (FIG. 8P), and a flexible hinge or connector comprising one or more layers 618 of a flexible and/or resilient material (FIG. 8M). As shown in FIG. 8M, layer 618 is formed with a major aperture 652 through which a pile extends, and a plurality of drain holes 654. The bracket 610, pile hoop 612, and ring 616 can be made of steel or any of various other suitable materials. Layer 618 can be made of elastomeric belting material, such as PLYLON® belting material. The pile hoop 612 can have an inner liner 614 (FIG. 8O) made of a low friction material, such as polyethylene, for engaging an adjacent surface of a respective pile. As shown in FIG. 8E, brackets 610 are secured on opposite sides to outer wale 636*a* of the first flotation subassembly 604*a* and to outer wale 632*a* of the second flotation subassembly 604*b*, such as by respective compression rods 38.

As shown in FIG. 8I, the flexible hinge comprises an upper layer 618*a* and a lower layer 618*b* separated by ring 616. The inner peripheral portions of the upper layer 618*a* and the lower layer 618*b* are disposed between the upper flange 530 of sleeve 522 and the pile hoop 612. A plurality of circumferentially spaced bolts 640 extend through corresponding holes in the flange 530, lower layer 618*b*, ring 616, and upper layer 618*a*, and pile hoop 612. Nuts 642 are tightly secured on the ends of respective bolts 640. The outer peripheral portions of the upper layer 618*a* and the lower layer 618*b* are secured to a horizontal extension 644 of bracket 610 via bolts 658 secured with respective nuts 660. Steel bars 656 (FIG. 8J) can be secured to the bracket 610 by bolts 658 and nuts 660 to reinforce the bracket.

As illustrated in FIGS. 8K and 8L, the flexible hinge allows for limited twisting and listing of the first and second flotation subassemblies 604*a*, 604*b* relative to the sleeve 522 and pile 12. This avoids binding of the sleeve 522 against the outer surface of the pile 12 as the flotation subassemblies rise and fall as the level of the water surface changes.

Eighth Representative Embodiment

Figure 9A:
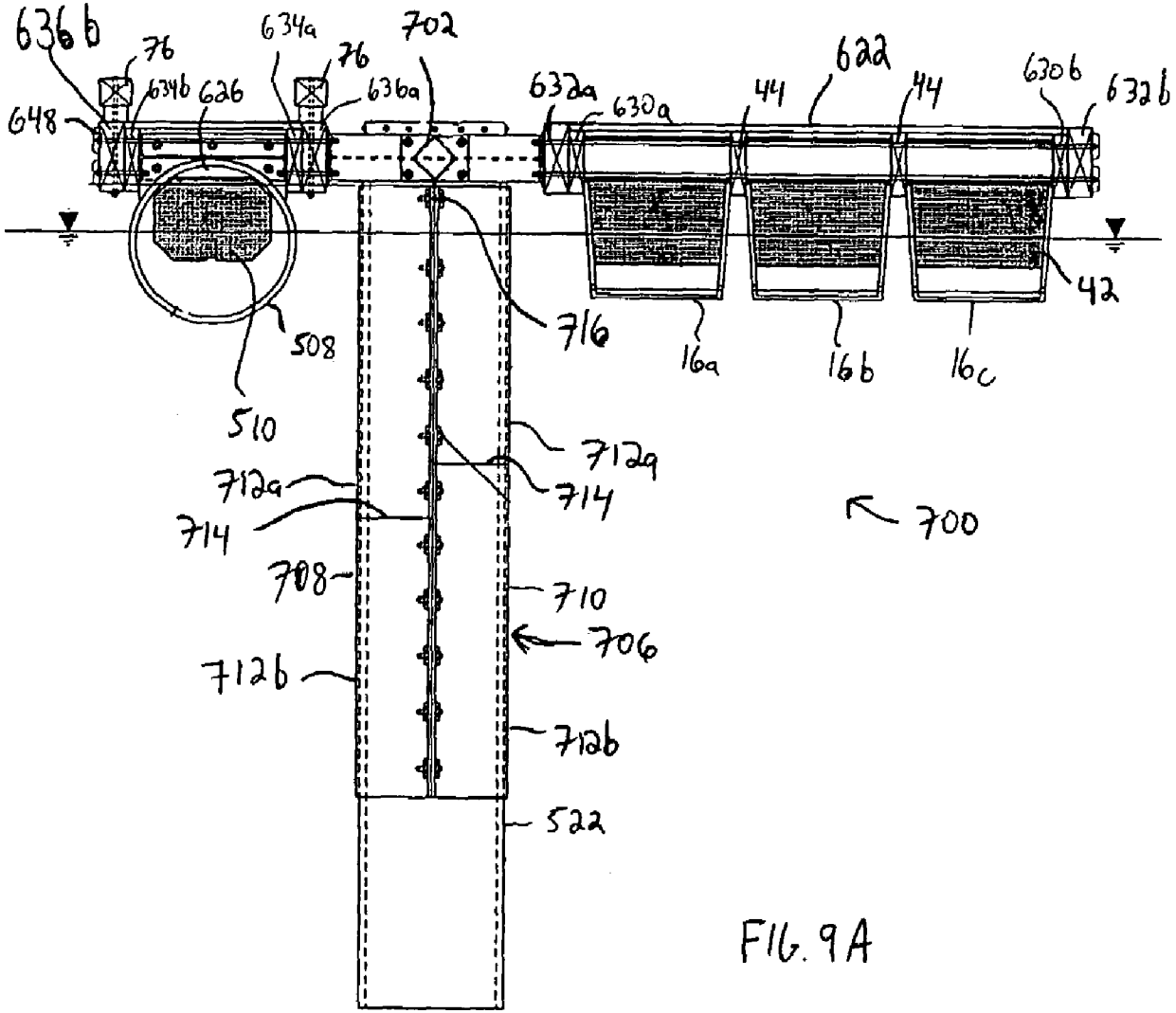
FIG. 9A is a partial, side elevation view of a wave-attenuating system according to an eight embodiment.
Figure 9B:
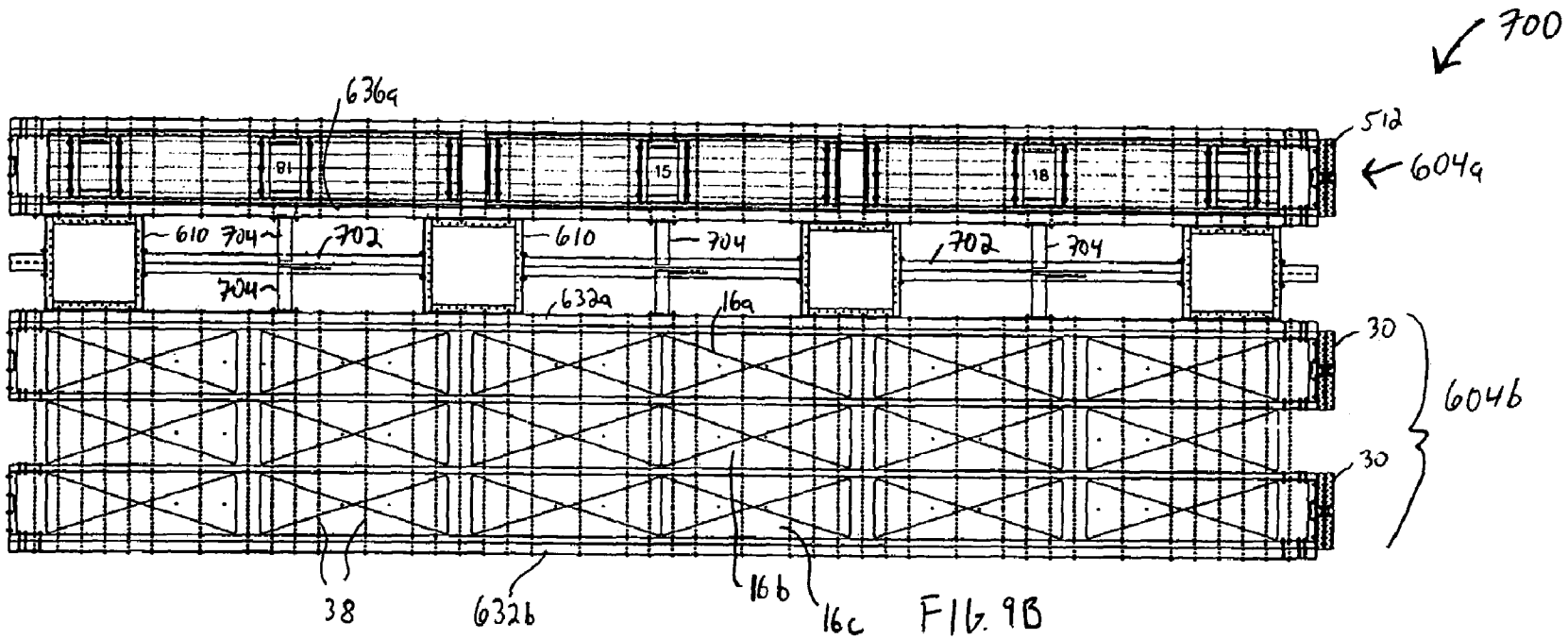
FIG. 9B is a partial, top plan view of the wave-attenuating system shown in FIG. 9A.

FIGS. 9A and 9B show a wave-attenuating system 700, according to an eighth representative embodiment. This embodiment shares many similarities with the embodiment of FIGS. 8A-8P. Hence, components in FIGS. 9A and 9B that are identical to corresponding components in FIGS. 8A-8P have the same respective reference numerals and are not described further.

One difference between the embodiment of FIGS. 8A-8P and the embodiment of FIGS. 9A and 9B is that the latter embodiment includes elongated structural members 702 connected to and extending between adjacent brackets 610. Structural members 702 can be, for example, elongated steel tubes. Lateral support members 704 (FIG. 9B) are connected to and extend inwardly from wales 632*a*, 636*a* to support decking 624 (FIG. 8A).

As shown in FIG. 9A, the wave-attenuating system 700 includes a barrier member 706. The barrier member 706 includes first and second layers 708, 710, respectively, each of which includes a respective upper section 712*a* and a respective lower section 712*b*. The first and second layers 708, 710 define respective seams 714 that are offset from one another to inhibit the flow of water through the barrier member 706. The upper sections 712*a* of the first and second layers 708, 710 can be secured to downwardly extending flanges 716 of structural members 702.

Ninth Representative Embodiment

Figure 10A:
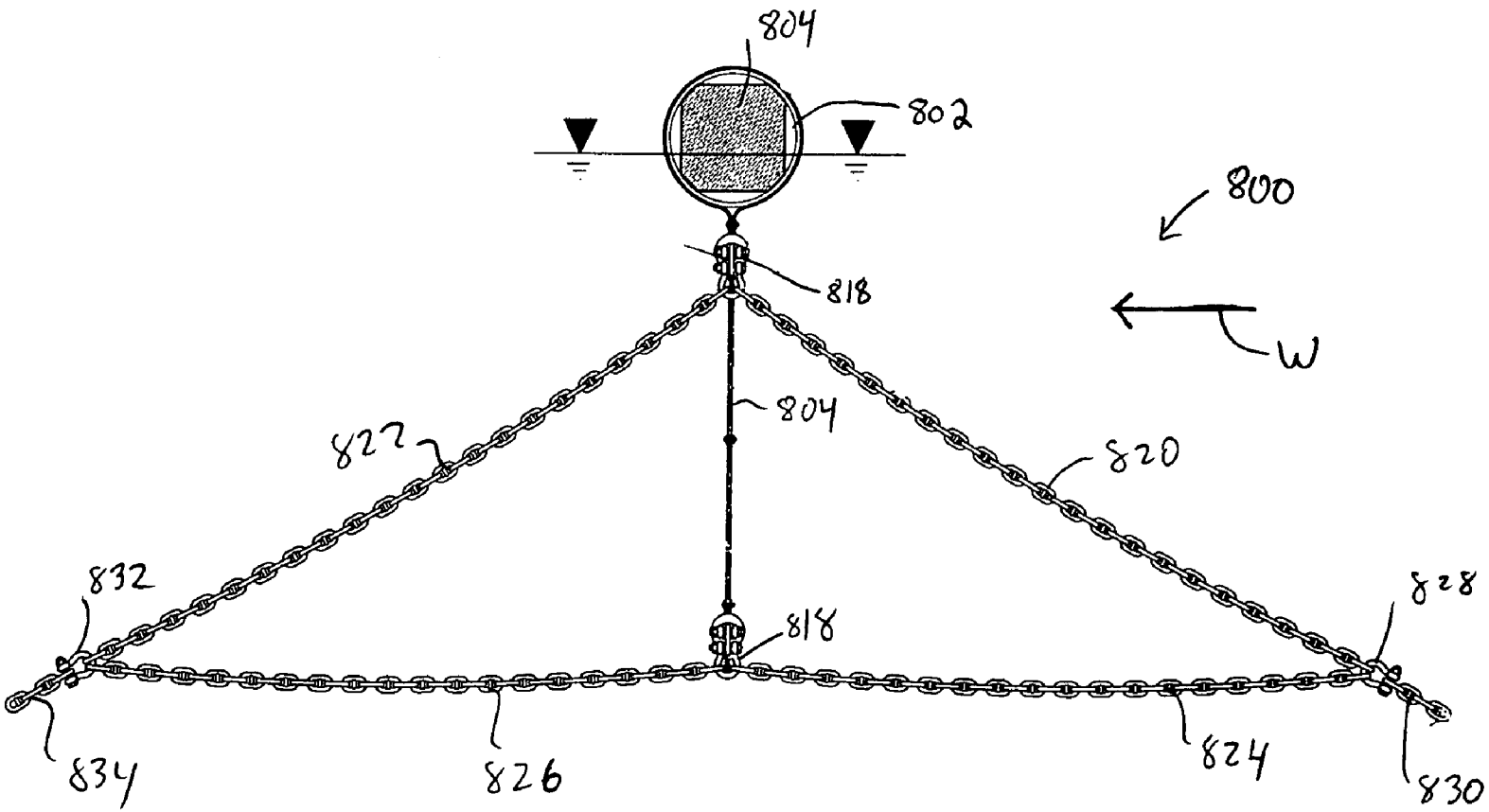
FIG. 10A is a vertical cross sectional view of a wave-attenuating system according to a ninth embodiment.
Figure 10B:
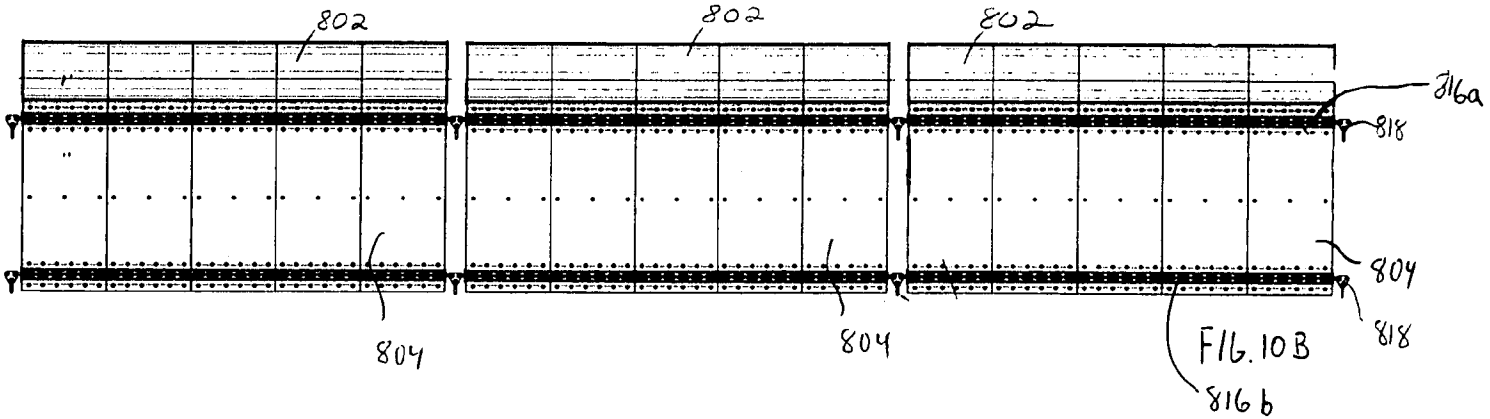
FIG. 10B is a partial, front elevation view of the wave-attenuating system shown in FIG. 10A.
Figure 10C:
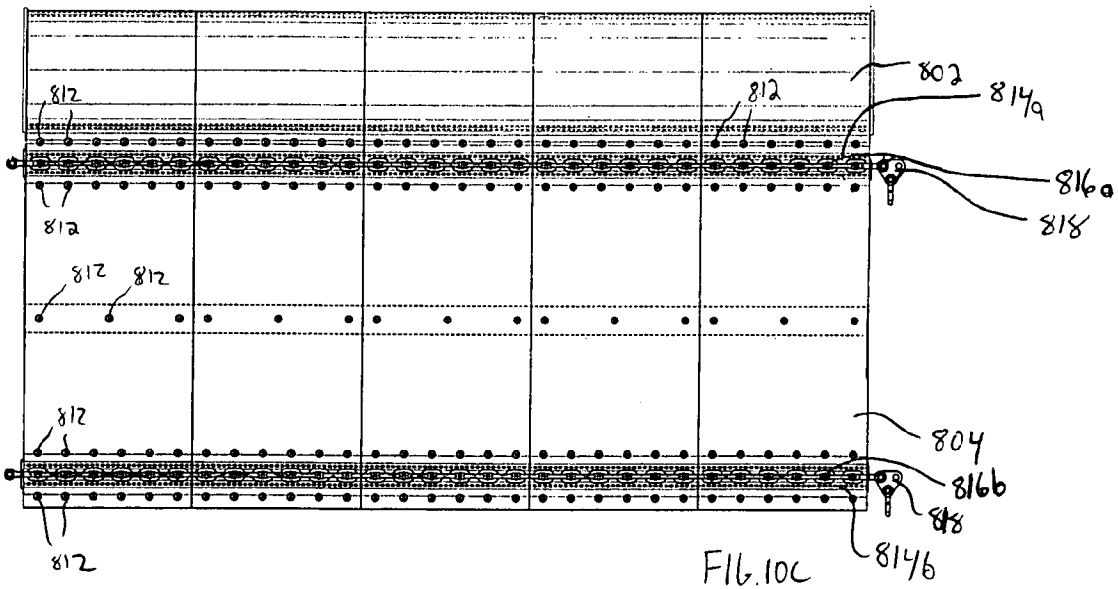
FIG. 10C is an enlarged, front elevation view of a flotation device and barrier member of the wave-attenuating system shown in FIG. 10A.
Figure 10D:
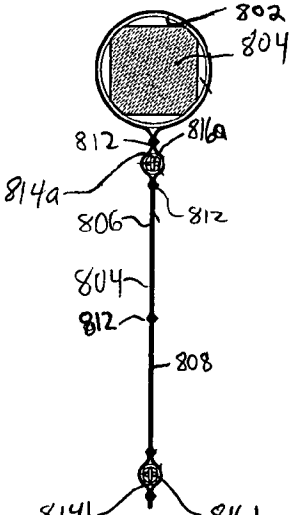
FIG. 10D is a partial, vertical cross sectional view of the wave-attenuating system shown in FIG. 10A.

FIGS. 10A-10D illustrate a wave-attenuating system 800, according to a ninth representative embodiment. The wave-attenuating system 800 includes a plurality of interconnected elongated, tubular floats 802 that can house respective buoyant cores 804. A respective barrier member 804 made of a flexible and/or resilient material (e.g., elastomeric belting material) extends around each float 802 and forms first and second layers 806 and 808, respectively, that extend downwardly from the float (FIG. 10D). The first and second layers 806, 808 can be secured to each other using bolts 812 or other suitable fasteners.

One or more elongated pipes or tubes 814*a*, 814*b* are disposed between the first and second layers 806, 808 and extend the length of the barrier member 804. As best shown in FIG. 10D, tube 814*a* can be positioned at the top of the barrier member just below the float 802 and tube 814*b* can be positioned at the bottom of the barrier member. The tubes 814*a*, 814*b* serve as housings for respective chains 816*a*, 816*b* that extend longitudinally between the first and second layers of each barrier member. The ends of the chains are connected to each other, such as with the illustrated couplings 818 (FIG. 10C), so as to form a continuous upper run of chains 816*a* extending through the barrier members and a continuous lower run of chains 816*b* extending through the barrier members.

Extending in opposite directions from each coupling 818 in the upper run of chains is a first chain 820 and a second chain 822 (FIG. 10A). Extending in opposite direction from each coupling 818 in the lower run of chains is a third chain 824 and a fourth chain 826. The outer ends of the first chain 820 and the third chain 824 can be connected to each other at a location in front of the barrier member, such as with the illustrated shackle 828, which in turn can be connected to an anchor chain 830 that is anchored to the seabed. Similarly, the outer ends of the second chain 822 and the fourth chain 826 can be connected to each other at a location in back of the barrier member, such as with the illustrated shackle 832, which is turn can be connected to an anchor chain 834 that is anchored to the seabed. This configuration maintains the barrier members 804 in a substantially perpendicular orientation relative to the direction of oncoming waves (indicated by arrow W).

In other embodiments, other types of mooring devices, such as cables or rope, could be use in lieu of the illustrated chains.

Tenth Representative Embodiment

Figure 11B:
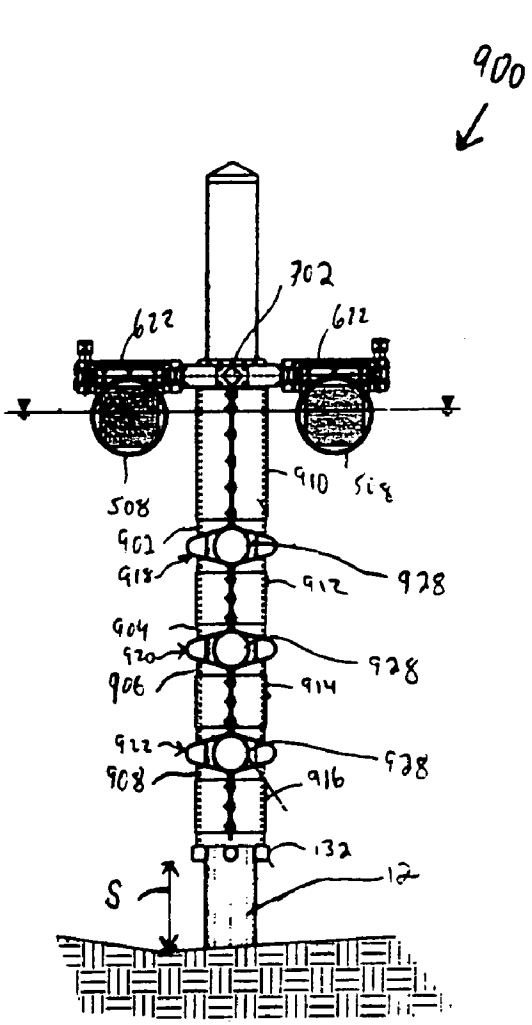
FIGS. 11A and 11B are side elevation views at different water levels of a wave-attenuating system, according to a tenth embodiment.
Figure 11A:
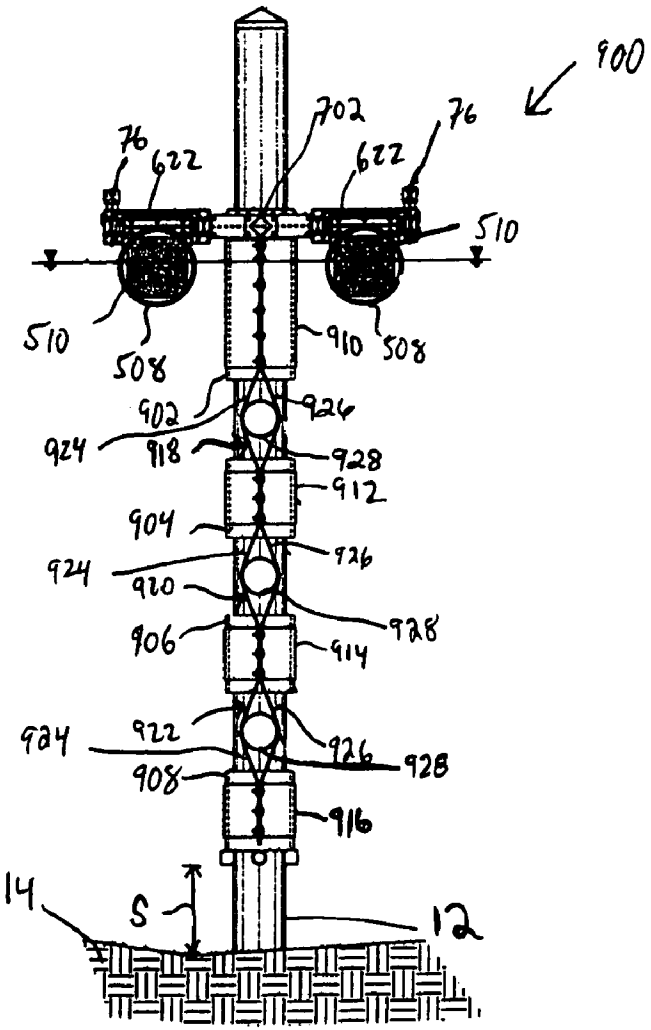

FIGS. 11A and 11B illustrate a wave-attenuating system 900, according to a tenth representative embodiment. The wave-attenuating system 900 includes a plurality of tubular flotation devices 508 on one side of a plurality of piles 12 and a plurality of flotation devices 508 on the other side of the piles 12. The flotation devices 508 support respective pedestrian decks 622 as previously described. Connection assemblies 608 (FIG. 8J) can be implemented to interconnect flotation devices on one side of the piles with flotation devices on the other side of the piles as previously described in connection with the embodiment shown in FIGS. 8A-8P.

The wave-attenuating system 900 has a construction that is similar to the wave-attenuating system 100 shown in FIGS. 3A and 3B. As shown, the wave-attenuating system 900 includes multiple, spaced apart sleeves 902, 904, 906, and 908 slidably disposed on each pile 12. Barrier members 910, 912, 914, and 916 extend horizontally between piles 12 and vertically along the lengths of sleeves 902, 904, 906, and 908, respectively. A barrier member 918 is connected to and extends vertically between barrier members 910 and 912; a barrier member 920 is connected to and extends vertically between barrier members 912 and 914; and a barrier member 922 is connected to and extends vertically between barrier members 914 and 916. Each barrier member 918, 920, 922 comprises respective first and second layers 924 and 926, between which there is disposed an elongated separation element 928. The separation elements 928 can be, for example, a non-corrosive, plastic (e.g., polyethylene) pipe and can be dimensioned to extend the entire length of the barrier members 918, 920, 922. This embodiment operates in a manner similar to the embodiment shown in FIGS. 3A and 3B. The separation elements 928 function to separate layers 924, 926 from each other and cause them to flex or bow in opposite directions under the weight of the flotation devices when the water level falls (FIG. 11B).

Eleventh Representative Embodiment

Figures 12A, 12B, 12C:
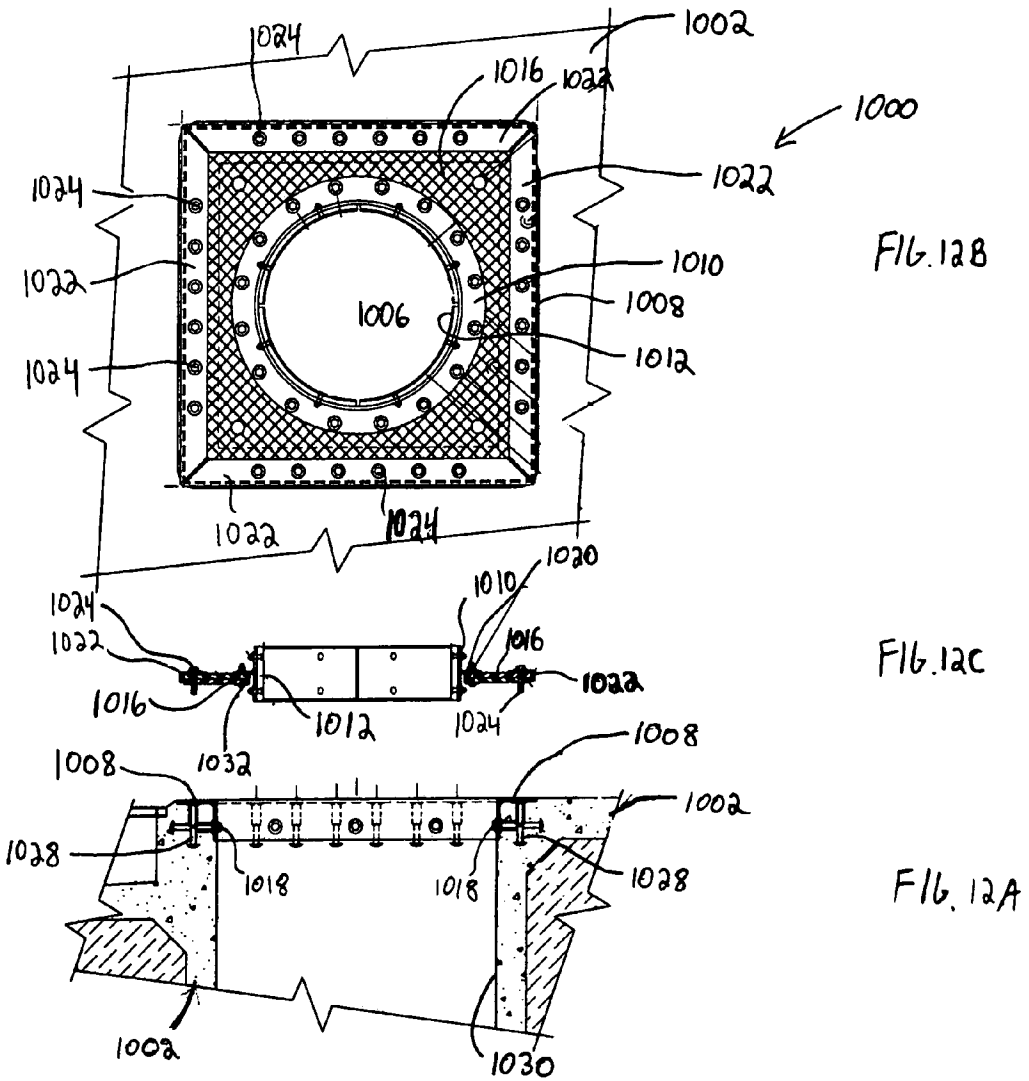
FIG. 12A is a fragmentary, side elevation view of a connection system for coupling a float to a pile.
FIG. 12B is a top plan view of the connection system shown in FIG. 12A.
FIG. 12C is a cross-sectional view of the connection system shown in FIG. 12A.

FIGS. 12A-12C illustrate a connection system 1000 for coupling a float 1002 to a pile 12, according to an eleventh representative embodiment. As shown in FIG. 12A, the float 1002 is formed with an opening 1030 through which the pile 12 (not shown in FIG. 12A) extends. The opening 1030 can be formed at any location along the length of the float, such as at an end portion or at the middle of the float. In addition, the float 1002 can be formed with multiple openings 1030, each having a respective connection system 1000 for coupling the float 1002 to more than one pile. The connection system 1000 in the illustrated configuration is formed with a major aperture 1006 dimensioned to receive the pile 12, and includes a generally square-shaped rigid frame, or bracket, 1008, a pile hoop, or sleeve, 1010 positioned within the bracket 1008 and through which the pile extends, a pile hoop liner 1012 made from a low-friction material on the inside of the pile hoop 1010, and a flexible hinge or connector 1014 comprising one or more layers of 1016 of a flexible and/or resilient material (e.g., an elastomeric belting material, such as PLYLON® belting material).

The illustrated bracket 1008 has a generally L-shaped cross-sectional profile and is secured to the float 1002, such as by casting the bracket 1008 in the upper end portion of the float surrounding the opening 1030 as shown. The bracket 1008 desirably is cast into the float such that the upper surface of the bracket is flush with the upper surface or deck of the float. The bracket 1008 can be further secured to the floats via bolts 1018. The inner peripheral portions of the layers 1016 are secured to a radially extending flange 1020 of the pile hoop 1010 by bolts 1032. The outer peripheral portions of the layers 1016 are secured to the bracket 1008 via clamping members 1022 positioned on all four sides of the bracket 1008 and bolts 1024. Bolts 1024 extend through corresponding openings in the clamping members 1022, the layers 1016, and the bracket 1008 and are tightened into inserts 1028 cast into the float 1002 so as to tightly compress the layers 1016 between the clamping members 1022 and the bracket 1008.

The connection system 1000 functions in a manner similar to the connection system 608 shown in FIG. 8A in that it allows for limited twisting and listing movement of the float 1002 relative to the pile so as to facilitate vertical movement of the float relative to the pile as the level of the water surface changes. The connection system 1000 can also be used to couple non-concrete floats (e.g., wooden floats) or other types of floatation devices to a pile. For example, if a wooden float is used, the bracket 1008 can be bolted to the deck of such float rather than being cast into the float as seen in the illustrated embodiment. The connection system 1000 also can be implemented in the embodiments shown in FIGS. 8A-8P and FIGS. 9A and 9B for interconnecting two floatation assemblies positioned on opposite sides of a pile and for coupling the floatation assemblies to the pile.

In the embodiment shown in FIG. 12A, the float 1002 itself serves as a wave attenuator. Although not shown in the figures, the float 1002 also can include a vertically disposed, flexible barrier member (e.g., barrier member 540 of FIG. 7A) to dissipate oncoming waves. In one implementation, for example, the float 1002 can include one or more elongated sleeves 522 (FIG. 7H) positioned in respective openings 1030 and a barrier member 540 secured to the sleeve 522, as previously described.

The present invention has been shown in the described embodiments for illustrative purposes only. The present invention may be subject to many modifications and changes without departing from the spirit or essential characteristics thereof. I therefore claim as my invention all such modifications as come within the spirit and scope of the following claims.

I claim:

1. A wave-dissipating system, comprising:

an upwardly extending pile coupled to the seabed;

a buoyant flotation member for floating upon a water surface, the flotation member being coupleable to the pile to allow movement upwardly and downwardly with respect to the pile as the level of the water surface changes;

a flexible barrier member that is supportable by the flotation member to extend below the water surface in an orientation to intercept the flow of waves;

wherein the flotation member supports an elongated sleeve member disposed around the pile and adapted to move vertically with respect to the pile;

the barrier member is connected to the sleeve member;

the flotation member is connected to the sleeve by a flexible connector defining a major aperture through which the pile extends, an inner peripheral portion at least partially surrounding the aperture, and an outer peripheral portion; and the sleeve is connected to the inner peripheral portion, and the outer peripheral portion is connected to the flotation member, the flexible connector configured to permit limited movement of the flotation member relative to the sleeve.

2. The wave-dissipating system of claim 1, wherein the barrier member comprises a first sheet and a second sheet coupled to the first sheet in a face-to-face relationship relative thereto, the sleeve member being disposed between the first and second sheets, and the first and second sheets are connected to each other at least at first and second spaced-apart locations on diametrically opposite sides of the sleeve.

3. The wave-dissipating system of claim 1, wherein the flotation member comprises a floating dock section.

4. The wave-dissipating system of claim 1, wherein:

the pile comprises a plurality of piles anchored into the seabed;

the flotation member comprises a plurality of flotation members, each flotation member being movably coupled to at least one of the plurality of piles so as to move upwardly and downwardly relative to the piles as the level of the water surface changes; and the barrier member extends horizontally between the piles.

5. The wave-dissipating system of claim 4, wherein the barrier member extends horizontally in a plane that intersects a vertical mid-plane of each pile.

6. The wave-dissipating system of claim 4, wherein the flotation members are placed end-to-end with respect to each other on one side of the piles.

7. The wave-dissipating system of claim 4, wherein:

the plurality of flotation members comprises a first set of flotation members and a second set of flotation members, the first set of flotation members placed end-to-end with respect to each other on one side of the piles and the second set of flotation members placed end-to-end with respect to each other on the opposite side of the piles; and the barrier members extends horizontally between the first and second sets of flotation members.

8. The wave-dissipating system of claim 1, wherein the flotation member is laterally offset from the pile.

9. The wave-dissipating system of claim 1, wherein the barrier member is resilient.

10. The wave-dissipating system of claim 1, wherein a predetermined minimum spacing is maintained between a bottom portion of the barrier member and the seabed as the flotation member moves upwardly and downwardly as the level of the water surface changes to allow fish to pass underneath the barrier member.

11. The wave-dissipating system of claim 10, further comprising at least first and second spaced-apart sleeves disposed around the pile, the sleeves being movable upwardly and downwardly relative to each other and the pile, the first sleeve being supported by the flotation member and connected to an upper portion of the barrier member, the second sleeve being connected to a lower portion of the barrier member.

12. The wave-dissipating system of claim 11, further comprising a mechanical stop disposed on the pile and positioned to limit downward movement of the second sleeve so as to maintain the predetermined minimum spacing.

13. The wave-dissipating system of 1, wherein the barrier member has a top edge at or above the water surface and a submerged bottom edge, wherein the bottom edge is maintained at a substantially constant elevation with respect to the seabed as the flotation member moves upwardly and downwardly as the level of water surface changes.

14. The wave-dissipating system of claim 13, wherein the barrier member bottom edge is maintained in constant contact with the seabed as the flotation member moves upwardly and downwardly as the level of the water surface changes.

15. The wave-dissipating system of claim 13, wherein the barrier member bottom edge is maintained at a constant elevation spaced above the seabed as the flotation member moves upwardly and downwardly as the level of the water surface changes.

16. The wave-dissipating system of claim 1, wherein the barrier member is laterally offset and spaced from a line extending along the longitudinal center of the flotation member.

* * * * *